US007524206B2

(12) United States Patent
Gutierrez et al.

(10) Patent No.: US 7,524,206 B2
(45) Date of Patent: Apr. 28, 2009

(54) POWER-ENABLED CONNECTOR ASSEMBLY WITH HEAT DISSIPATION APPARATUS AND METHOD OF MANUFACTURING

(75) Inventors: Aurelio J. Gutierrez, Bonita, CA (US); Victor H. Renteria, Poway, CA (US); Russell L. Machado, San Diego, CA (US); Chris Schaffer, Fallbrook, CA (US); Henry Hinrichs, San Diego, CA (US)

(73) Assignee: Pulse Engineering, Inc., San Diego, CA (US)

( * ) Notice: Subject to any disclaimer, the term of this patent is extended or adjusted under 35 U.S.C. 154(b) by 0 days.

(21) Appl. No.: 11/387,226

(22) Filed: Mar. 22, 2006

(65) Prior Publication Data

US 2007/0015416 A1 Jan. 18, 2007

Related U.S. Application Data

(60) Provisional application No. 60/668,411, filed on Apr. 4, 2005, provisional application No. 60/664,873, filed on Mar. 23, 2005.

(51) Int. Cl.
*H01R 13/00* (2006.01)
*H01R 13/648* (2006.01)

(52) U.S. Cl. ..... 439/487; 439/607

(58) Field of Classification Search ..... 439/487, 439/607–610, 490, 676, 540.1
See application file for complete search history.

(56) References Cited

U.S. PATENT DOCUMENTS 5,015,981 A 5/1991 Lint et al.
5,260,994 A 11/1993 Suffi
5,973,932 A 10/1999 Nguyen
5,986,894 A 11/1999 Lint et al.
6,005,463 A 12/1999 Lint et al.
6,101,092 A * 8/2000 Onishi ..... 361/705
6,179,668 B1 1/2001 Kan
6,243,654 B1 6/2001 Johnson et al.
6,250,936 B1 * 6/2001 Armistead et al. ..... 439/98
6,305,987 B1 10/2001 Crane, Jr. et al.
6,308,235 B1 10/2001 Scharf et al.
6,310,781 B1 10/2001 Karam
6,344,969 B1 2/2002 Lord et al.
6,395,983 B1 5/2002 Gutierrez
6,431,764 B1 8/2002 Scharf et al.
6,497,588 B1 12/2002 Scharf et al.
6,585,540 B2 7/2003 Gutierrez et al.
6,593,840 B2 7/2003 Morrison et al.
6,628,531 B2 9/2003 Dadafshar
6,641,440 B1 11/2003 Hyland et al.

(Continued)

*Primary Examiner*—Chandrika Prasad
(74) *Attorney, Agent, or Firm*—Gazdzinski & Associates, PC

(57) ABSTRACT

An advanced connector assembly enabled to receive and distribute power signals. In one embodiment, the connector comprises a single port modular jack, and incorporates an insert assembly disposed in the rear portion of the connector housing. The insert assembly includes first and second substrates and a cavity adapted to receive one or more electronic or signal conditioning components. Heat removal features are also utilized within the jack to effectively dissipate heat produced by the electronic or signal conditioning components. The insert assembly is also optionally made removable from the jack housing such that an insert assembly of a different electronics or terminal configuration can be substituted therefor. In this fashion, the connector can be configured to a plurality of different standards (e.g., Gigabit Ethernet, 10/100, etc.). Methods for manufacturing the aforementioned embodiments are also disclosed.

15 Claims, 18 Drawing Sheets

U.S. PATENT DOCUMENTS 6,642,827 B1 11/2003 McWilliams et al.
6,739,912 B2 5/2004 Korsunsky et al.
6,764,343 B2 7/2004 Ferentz
6,848,943 B2 2/2005 Machado et al.
6,881,096 B2 4/2005 Brown et al.
6,899,547 B1 5/2005 Chang et al.
6,909,943 B2 6/2005 Lehr et al.
6,916,206 B2 7/2005 Ferentz
6,962,511 B2 11/2005 Gutierrez et al.
7,026,730 B1 4/2006 Marshall et al.
7,033,210 B1 * 4/2006 Laurer et al. ..... 439/541.5
7,052,315 B2 * 5/2006 Murr et al. ..... 439/540.1
7,121,898 B2 * 10/2006 Murr et al. ..... 439/676
7,175,444 B2 * 2/2007 Lang et al. ..... 439/76.1
7,187,563 B1 3/2007 Bobrek
7,254,035 B2 * 8/2007 Sasaki et al. ..... 361/721
7,265,984 B2 * 9/2007 Numata ..... 361/719
7,312,998 B2 * 12/2007 Kamemoto et al. ..... 361/719
2002/0072274 A1 * 6/2002 Flickinger et al. ..... 439/607
2003/0061522 A1 3/2003 Ke et al.
2003/0107269 A1 6/2003 Jetzt
2005/0220425 A1 * 10/2005 Kropp et al. ..... 385/88
2006/0009061 A1 1/2006 Machado

* cited by examiner

TOP VIEW

SECTION A-A

POWERED DEVICE BASED ON LINEAR TECHNOLOGY LT4257

POWERED DEVICE BASED ON DISCRETE COMPONENTS

POWERED DEVICE BASED ON TEXAS INSTRUMENTS TPS2375

| CLASS | RESISTANCE |
|---|---|
| 0 | 4420, 1% |
| 1 | 963, 1% |
| 2 | 549, 1% |
| 3 | 357, 1% |
| 4 | 255, 1% |

NOTES:
1. UNLESS OTHERWISE SPECIFIED. ALL RESISTORS ARE 5%, 62.5mW. AND ARE VALUED IN OHMS.
2. UNLESS OTHERWISE SPECIFIED. ALL CAPACITORS ARE 10% AND ARE VALUED IN MICROFARADS.
3. ELIMINATE COMPONENTS WITHIN DOTTED AREA FOR OPERATION AS LEGACY PD CONTROLLER.

POWER-ENABLED CONNECTOR ASSEMBLY WITH HEAT DISSIPATION APPARATUS AND METHOD OF MANUFACTURING

PRIORITY CLAIM

This application claims priority benefit of co-owned U.S. Provisional Patent Application Ser. No. 60/664,873 of the same title filed Mar. 23, 2005, and U.S. Provisional Patent Application Serial No. 60/668,411 of the same title filed Apr. 4, 2005, both of which are incorporated herein by reference in their entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

1. Field of the Invention

The present invention relates generally to electronic components and particularly to an improved design and method of manufacturing a single- or multi-port connector assembly (e.g., modular jack) that may include internal electronic components adapted for electrical power delivery and/or distribution.

2. Description of Related Technology

Existing modular jack/connector technology commonly utilizes individual discrete and passive components such as choke coils, filters, resistors, capacitors, transformers, and LEDs disposed within the connector to provide the desired functionality. More recently, so-called "active" components have begun to appear in usage in conjunction with modular jack/connector technology, and have added to the functionality available with these integrated modular jack connectors.

For example, U.S. Pat. No. 5,260,994 to Suffi issued on Nov. 9, 1993 and entitled "Maintenance termination unit module" discloses a maintenance termination unit module for housing electronic equipment including a maintenance termination unit electronic circuit for use in a telecommunications network which comprises a housing portion and a base portion. The electronic equipment is located within the housing portion, and presents external circuit connection points at electrically conducting elements which are disposed through a base to form a plug portion. The electrically conducting elements are arranged in the plug portion in a configuration which matches a predetermined socket configuration of a type used in telecommunications networks so that the plug portion can be inserted into such a pin socket configuration. The base portion is mountable on the housing portion so that the electrically conducting elements can be electrically connected to the electronic equipment.

U.S. Pat. No. 6,179,668 to Kan issued on Jan. 30, 2001 and entitled "Electric connector including a circuit board" discloses an electric connector that includes a terminal board and a circuit board housed in a plastic body for connecting electric power to an electric device. The terminal board has a plurality of upper terminals and lower terminals integrally formed therein. The upper terminals have curved contacts extending into a cavity formed in a vertical section of the terminal board. The lower section forms two rows of curved contacts at one end extending into the cavity. The curved contacts of the terminals may engage with the circuit board securely in the terminal board. While the terminal board may establish the electric connection required, the circuit board may change input current and signals to provide additional function, improved filtering, cross talk reduction, and the like.

U.S. Pat. No. 6,243,654 to Johnson, et al. issued on Jun. 5, 2001 and entitled "Transducer assembly with smart connector" discloses a transducer assembly for connection with a digital signal processing system which includes an analog transducer, a digital connector assembly movable relative to the analog transducer to facilitate connection with the digital signal processing system, and a cable permanently affixed between the analog transducer and the digital connector assembly to convey an analog transducer signal therebetween. The digital connector assembly includes a connector housing, a digital connector mounted by the connector housing to mate in a detachable manner with the digital signal processing system, and transducer interface circuitry disposed within the connector housing in a non-removable manner and including a digital storage device programmed to store digital transducer data, such as transducer identification, configuration settings and calibration or correction factors, for retrieval by the digital signal processing system. The transducer interface circuitry can also include signal conditioning circuitry and a microcontroller. Incorporating the transducer data memory and interface circuitry in the connector housing allows conventional transducers to be used without modifying existing mounting techniques and, at the same time, provides traceability of the transducer and its calibration data.

U.S. Pat. No. 6,305,987 to Crane, Jr., et al. issued on Oct. 23, 2001 and entitled "Integrated connector and semiconductor die package" discloses an integrated module that includes a connector for detachable connection to a signal source, with the connector having internal electrically conductive pins, and a housing defining a cavity for holding at least one semiconductor die. The housing includes side walls and an end plate joined to the side walls. Electrically conductive leads extend through at least one of the side walls with each of the leads including an internal lead section extending within the cavity and an external lead section extending externally of the cavity through at least one side wall. One of the side walls of the housing includes a portion that is attached to the connector, with the side walls and a bottom part of the connector being formed as one integrally molded part or as two separate parts that are joined together using processes such as ultrasonic welding. A printed circuit board can also form part of the integrated module, with the printed circuit board either being mounted in spaced parallel relation to the end plate on pegs that extend upwardly from the side walls of the housing, or the printed circuit board can be mounted between the connector and the housing either perpendicular to or parallel with the end plate of the housing. Passive components can be mounted on the printed circuit board and electrically connected to pins within the connector as well as to semiconductor dies mounted on the end plate within the housing. The electrically conductive leads extending from the side wall on one side of the integrated module can be offset relative to the electrically conductive leads extending from the opposite side wall such that two identical integrated modules can be mounted close to each other with the electrically conductive leads overlapping, thus optimizing space utilization.

U.S. Pat. No. 6,308,235 to Scharf, et al. issued on Oct. 23, 2001 and entitled "Multi-port communications device and associated methods" discloses a communications device that includes a multi-port jack housing having portions defining a plurality of recesses extending inwardly from the front for receiving respective mating plugs. Signal connectors are preferably positioned within each of the recesses and define respective communications ports. A circuit board is positioned within the multi-port jack housing and preferably extends adjacent the back. The communications device preferably includes at least one communications processor mounted on the circuit board and connected to the plurality of communications ports for processing inbound and outbound communications signals. A communications processor preferably communicates with two or more of the communications ports. In embodiments including a plurality of communications processors, a communications bus is provided on the circuit board interconnecting the communications processors. The signal connectors may be electrical and/or optical, and may be compatibility with an RJ-45 jack. An internal EMI shield may be provided in the circuit board.

U.S. Pat. No. 6,310,781 to Karam issued on Oct. 30, 2001 and entitled "Connection pin layout for connecting integrated magnetics modules to a printed circuit board" discloses a connection pin layout for connecting one or more integrated magnetics modules (IMMs) to a printed circuit board (PCB) for reduced electromagnetic interference (EMI) includes grouping and locating the connection pins based on the signals passed through the connection pins and a method of routing traces to the connection pins. The connection pins carrying power between the PCB and the IMMs are located together and on the periphery of the connection pin layout. The traces to the power pins are routed to avoid passing under the data and ground connection pins or crossing the traces to the data and ground connection pins. When multiple IMMS are connected to a PCB, the connection pin layout coordinates the location of connection pins among IMMs and integrates the grouping of the connection pins for multiple IMMs.

U.S. Pat. No. 6,344,969 to Lord, et al. issued on Feb. 5, 2002 and entitled "Switched multi-port communications device and associated methods" discloses a switched communications device that includes a multi-port jack housing having portions defining a plurality of recesses extending inwardly from the front for receiving respective mating plugs. Signal connectors are preferably positioned within each of the recesses and define respective communications ports. A circuit board is positioned within the multi-port jack housing and preferably extends adjacent the back. The switched communications device preferably includes at least one switched communications processor mounted on the circuit board and connected to the plurality of communications ports for processing inbound and outbound communications signals so that the signals are switched among the communications ports. A switched communications processor preferably communicates with two or more of the communications ports. The signal connectors may be electrical and/or optical, and may be compatible with an RJ-45 jack. An internal EMI shield may be provided in the circuit board.

U.S. Pat. No. 6,431,764 to Scharf, et al. issued on Aug. 13, 2002 and entitled "Optical transceiver RJ-jack with EMI shield" discloses a communications transceiver that includes a jack housing which, in turn, includes portions defining a recess for receiving a mating plug therein. Signal connector elements are provided within the recess for establishing inbound and outbound signal paths with corresponding signal connector elements of the mating plug. A circuit board within the jack housing preferably comprises an electrically conductive layer defining a first internal electromagnetic interference (EMI) shield. Accordingly, at least one first circuit device being susceptible to EMI is mounted on a first side of the circuit board, and at least one second circuit device generating EMI and is mounted on the circuit board on a second side thereof opposite the first side. The first internal EMI shield extends between the at least one first circuit device and the at least one second circuit device. The transceiver may include an electrically conductive layer on outer surface portions of the jack housing defining an external EMI shield. And the first internal EMI shield may be electrically connected to the external EMI shield. The transceiver may operate over an optical fiber path or a twisted pair path.

U.S. Pat. No. 6,497,588 to Scharf, et al. issued Dec. 24, 2002 and entitled "Communications transceiver with internal EMI shield and associated methods" discloses a communications transceiver that includes a jack housing which, in turn, includes portions defining a recess for receiving a mating plug therein. Signal connector elements are provided within the recess for establishing inbound and outbound signal paths with corresponding signal connector elements of the mating plug. A circuit board within the jack housing preferably comprises an electrically conductive layer defining a first internal electromagnetic interference (EMI) shield. Accordingly, at least one first circuit device being susceptible to EMI is mounted on a first side of the circuit board, and at least one second circuit device generating EMI and is mounted on the circuit board on a second side thereof opposite the first side. The first internal EMI shield extends between the at least one first circuit device and the at least one second circuit device. The transceiver may include an electrically conductive layer on outer surface portions of the jack housing defining an external EMI shield. And the first internal EMI shield may be electrically connected to the external EMI shield. The transceiver may operate over an optical fiber path or a twisted pair path.

U.S. Pat. No. 6,641,440 to Hyland, et al. issued on Nov. 4, 2003 and entitled "Electrical connector with power module" discloses an electrical connector for mounting on a main printed circuit board (PCB) that includes an insulative housing defining a plurality of cavities, a plurality of contacts received in the housing and extending into the cavities, and a shield member substantially surrounding the housing. An internal PCB, a first and a second magnetic module, and a power module are received in a rear opening of the housing. A plurality of conductors electrically connect the internal PCB with the first and the second magnetic modules and the power module. An internal ground plate electrically engages with the internal PCB and mechanically engages with the first and the second magnetic modules and the power module.

U.S. Pat. No. 6,739,912 to Korsunsky, et al. issued on May 25, 2004 and entitled "Modular jack assembly having improved positioning means" discloses an electrical connector assembly that includes an insulating housing and an electrical subassembly disposed within the housing. The housing defines a receiving space in a rear face, and at least one groove and recess extending in a back-to-front direction beside the receiving space. The electrical subassembly includes first and second printed circuit boards each having at least one side conductor attached thereon, a pair of magnetic modules respectively connecting with the first and second PCBs for suppressing noise, and a metal plate sandwiched between the magnetic modules. The metal plate has at least one projection. When the electrical subassembly is assembled to the housing through the receiving space, the at least one side conductor and projection are respectively received in the at least one groove and recess, thereby ensuring the electrical subassembly being accurately inserted into the housing.

U.S. Pat. No. 6,764,343 to Ferentz issued Jul. 20, 2004 and entitled "Active local area network connector" discloses an active connector for use in a local area network (LAN) including at least one LAN node. The active connector includes a connector housing, at least one first plurality of first electrical contacts mounted in the housing and arranged for detachable connection with corresponding electrical contacts of at least one plug, at least one second plurality of second electrical contacts mounted in the housing and arranged for connection with corresponding electrical contacts of local area network equipment and active power control circuitry located within the housing and coupled to at least some of the first and second electrical contacts, the active power control circuitry being operative for controlling the supply of electrical power over the local area network cabling to at least one node of the local area network.

U.S. Pat. No. 6,848,943 to Machado, et al. issued on Feb. 1, 2005 and entitled "Shielded connector assembly and method of manufacturing" discloses an advanced shielded modular plug connector assembly incorporating a removable insert assembly disposed in the connector housing, the insert assembly is adapted to optionally receive one or more electronic components. In one exemplary embodiment, the connector assembly comprises a single port connector with integral shielded housing and dual-substrate insert assembly. The housing is advantageously formed using a metal casting process which inherently shields the connector (and exterior environment) from EMI and other noise while allowing for a reduced housing profile. In another embodiment, a plurality of light sources are disposed within (and shielded by) the metallic housing. In yet another embodiment, the connector assembly comprises a multi-port "1×N" device. In yet another embodiment, a bail mechanism is provided to permit easy insertion/removal of the connector assembly from an external structure such as a rack or enclosure. Methods for manufacturing the aforementioned embodiments are also disclosed.

U.S. Pat. No. 6,881,096 to Brown, et al. issued Apr. 19, 2005 and entitled "Compact serial-to-ethernet conversion port" discloses a serial-to-ethernet modular converter jack and a method of fabricating of the same. The serial-to-ethernet converter electronic components, including the control software stored in on-board memory are miniaturized and housed entirely in an RJ-45 jack. The present invention is constructed of a shielded housing that defines an open front portion for a connector port. The housing of the present invention also includes a segregated interior chamber, which encases all of the electrical components necessary to complete a serial-to-ethernet conversion of data. Lead pins electrically connected to the circuitry within the interior chamber, protrude from the based of the connector jack providing for a means to mate the jack to a circuit board. First, second and third circuit boards collectively incorporate the serial-to-ethernet circuitry components. Both the first circuit board incorporating magnetic circuitry and the second circuit board incorporating control circuitry are positioned in generally horizontal parallel relation within the interior chamber. The second circuit board which defines opposed sides includes electronic components disposed upon the upper and lower of both sides of said second circuit board. The third circuit board, incorporating connections to the LEDs, is positioned generally perpendicular in relation to the first and second circuit boards and is structurally connected to said first and second circuit boards, additionally providing an electrical connection between the first and second boards. Alternative embodiments of the invention are disclosed and include various arrangement of the serial-to-ethernet circuitry within the interior chamber of the housing.

U.S. Pat. No. 6,916,206 to Ferentz issued Jul. 12, 2005 and entitled "Active local area network connector with line interrogation" discloses an active local area network connector comprising: an active connector housing for use with local area network (LAN) equipment; first electrical contacts mounted in the housing and arranged for detachable connection with corresponding electrical contacts of at least one plugs, the first electrical contacts comprising at least one data pair for transmitting data between the local area network equipment and at least one LAN node; second electrical contacts mounted in the housing and arranged for connection with corresponding electrical contacts of the local area network equipment, the second electrical contacts carrying electrical power for the at least one LAN node; and active power circuitry located within the housing and coupled to at least one of the at least one data pair and at least one of the second electrical contacts, the active power circuitry comprising voltage measuring circuitry, the voltage measuring circuitry being employable for line interrogation.

United States Patent Publication No. 20030061522 to Ke, et al. published on March 27, 2003 and entitled "Network switching apparatus for supplying power to network communication equipment through twisted pair line" discloses a network switching apparatus for supplying power to network communication equipment through a twisted pair line comprising a power control circuit having a plurality of sockets, each socket connected with a RJ-45 connector so as to electrically connect the switching apparatus to a corresponding socket of the communication equipment through the twisted pair line of RJ-45 connector, and ostensibly having the ability to identify, in accordance with specifications stipulated in IEEE 802.3af, whether the communication equipment has the capability of receiving power from each socket through the twisted pair line prior to supplying power to the communication equipment.

United States Patent Publication No. 20030107269 to Jetzt, published on Jun. 12, 2003 and entitled "Methods and devices for providing power to network-based systems" discloses circuits that provide power to network-based devices, such as IP telephones, using spare conductors within existing LAN cables. The circuits, which may comprise diode bridges, are designed to provide power using existing and planned industry guidelines.

Despite the foregoing, improved connector apparatus and assembly methods are needed for, inter alia, so-called power-over-ethernet ("PoE") functionality. Specifically, none of the foregoing solutions appear to contemplate devices active capability on the receiving (versus supply) end of a connector or modular jack interface.

Furthermore, heat generation by such active components within the small physical constraints of a jack or connector is often a critical issue which has not been satisfactorily addressed under the prior art. This presents a formidable practical limitation, since as connector/jack technology becomes increasingly miniaturized, and higher component densities are employed, the rate of heat generation from such active components places increasing demands on the ability to remove or dissipate such heat before damage can occur to other components (or the active component itself).

Accordingly, improved connector apparatus with integrated active components for use on, e.g., the powered device ("PD") side of PoE systems such as those compliant with IEEE Std. 802.3af is needed. Ideally, such an apparatus would: (i) integrate power delivery (e.g., PoE) functionality into a modular connector design, thereby obviating the need to integrate the PoE functionality into the PD itself, and (ii) provide a mechanism for the effective dissipation of heat generated by these PoE circuits.

For multi-port connectors, such an apparatus would also integrate PoE functionality into one or more ports of the multi-port connector, thereby providing a high density PoE solution for a plurality of ports associated with a parent device.

SUMMARY OF THE INVENTION

The present invention satisfies the foregoing needs by providing improved apparatus and methods for power delivery and receipt via, e.g., circuitry associated with a modular jack or other connector type.

In a first aspect of the invention, an improved connector assembly for use on, inter alia, a printed circuit board or other device is disclosed. In one exemplary embodiment, the assembly comprises a connector housing having a single port, a plurality of conductors disposed within the recess for contact with the terminals of a modular plug, and first and second substrates disposed in the rear portion of the housing, the substrates (and their respective traces) forming part of the electrical pathway between the conductors and the corresponding circuit board leads. The substrates mate with terminals of at least one insert assembly, the latter optionally having a plurality of signal conditioning components disposed in the signal path between the aforementioned conductors and those mating with the parent device (e.g., motherboard or PCB). The insert assembly can be adapted to any number of lead (and electronics) configurations and applications. In one variant, electronic components are mounted on the substrate (s), the electronic components comprising power control circuitry being operative for receiving the supply of electrical power over the local area network cabling of the local area network and utilizing a Power-over-Ethernet (PoE) interface controller. The connector assembly is also optionally equipped with one or more indicators and/or light sources (e.g., LEDs, light pipes, etc.) In another variant of the connector assembly, power control circuitry compliant with IEEE Std. 802.3af is disclosed for use as the front end of a powered device (PD).

In a second exemplary embodiment, the assembly comprises a connector housing having a plurality of connector recesses, the recesses arranged in substantially over-under and side-by-side orientation. In a variant of this second exemplary embodiment, at least one of the individual ports has Power-over-Ethernet (PoE) functionality (including power control circuitry at least partly disposed within the connector assembly) wherein at least one port can receive power from power sourcing equipment (PSE) and distribute the power accordingly to at least one of the remainder of the ports, and/or other connected devices. In another variant of the multi-port embodiment, each port contains power control circuitry adapted to receive power from a PSE device and distribute the power to a connected device.

In a third exemplary embodiment, the assembly is mounted in a vertical arrangement such that the engagement and insertion direction of the modular plug into the connector housing is substantially orthogonal to the parent device board. In one variant of this third exemplary embodiment, the multi-port vertical mount connector comprises multiple ports. In a second variant, the vertical mount connector arrangement (single or multiple port) contains power control circuitry suitable for, e.g., receiving power-over-network signals.

In yet another embodiment, the connector assembly comprises a multi-part body element with external noise shield, the latter also being used to dissipate thermal energy generated by one or more of the power control circuit components. In one variant, a dual-controller circuit is used within the connector body, and heat is dissipated to the shield substantially through an open-top housing, as well as other pathways (including staking).

In a third aspect of the invention, an improved electronic assembly utilizing the aforementioned connector assembly is disclosed. In one exemplary embodiment, the electronic assembly comprises the foregoing connector assembly which is mounted to a printed circuit board (PCB) substrate having a plurality of conductive traces formed thereon, and bonded thereto using a soldering process, thereby forming a conductive pathway from the traces through the conductors of the respective connectors of the package. In another embodiment, the connector assembly is mounted on an intermediary substrate, the latter being mounted to a PCB or other component using a reduced footprint terminal array.

In a fourth aspect of the invention, an improved method of manufacturing the connector assembly of the present invention is disclosed. In one embodiment, the method comprises: forming an assembly housing having at least one modular plug receiving recess and at least one rear cavity disposed therein; providing a plurality of conductors comprising a first set adapted for use within the first recess of the housing element so as to mate with corresponding conductors of a modular plug; providing at least two substrates having electrical pathways formed thereon, and adapted for receipt within the rear cavity; terminating one end of the conductors of the first set to a first substrate; providing a second and third set of conductors adapted for termination to the at least two substrates and having at least one terminal to the external device (e.g., circuit board) to which the connector will be mated, thereby forming an electrical pathway from the modular plug (when inserted in the recess) through at least one of the conductors of the first to the distal end of at least one of the conductors of the second and third sets.

In another embodiment of the method, one or more electronic components are mounted on the substrate(s), thereby providing an electrical pathway from the modular plug terminals through the electronic component(s) to the distal ends of the second and third terminals.

In another embodiment of the method, the electronic components comprise power control circuitry, the power control circuitry being operative for controlling the receipt of electrical power over the local area network cabling of the local area network and utilizing an integrated PoE interface controller.

In a fifth aspect of the invention, improved dual-controller power control circuitry is disclosed, wherein additional power handling (and heat dissipation) capability is provided. In one embodiment, the circuitry uses two Schottky rectifiers in conjunction with the controllers, as well as heat dissipation through the external noise shield or other proximate structures. This approach permits maximum power handling capability within a small substantially enclosed form factor (such as an exemplary RJ 45 modular jack).

In a sixth aspect of the invention, a heat dissipation apparatus for use within an electrical connection device is disclosed. In one embodiment, the apparatus comprises: a circuit; a substrate onto which said circuit is disposed; a plurality of electrically and thermally conductive terminals; and a substantially metallic shield element, at least a portion of which is in contact with said substrate; wherein architecture is configured to dissipate heat generated by said circuit via at least said terminals and said shield element. In one variant, the connection device comprises a modular jack, and the circuit comprises a bare integrated circuit die mounted to the substrate using a chip-on-board (COB) approach.

In a seventh aspect of the invention, power control circuitry for use in, inter alia, a modular jack or other electrical connection device is disclosed. In one embodiment, the circuitry comprises a PoE controller integrated circuit device disposed in a circuit having a plurality of rectifier bridges.

BRIEF DESCRIPTION OF THE DRAWINGS

The features, objectives, and advantages of the invention will become more apparent from the detailed description set forth below when taken in conjunction with the drawings, wherein.

DETAILED DESCRIPTION OF THE PREFERRED EMBODIMENT

Figure 1:
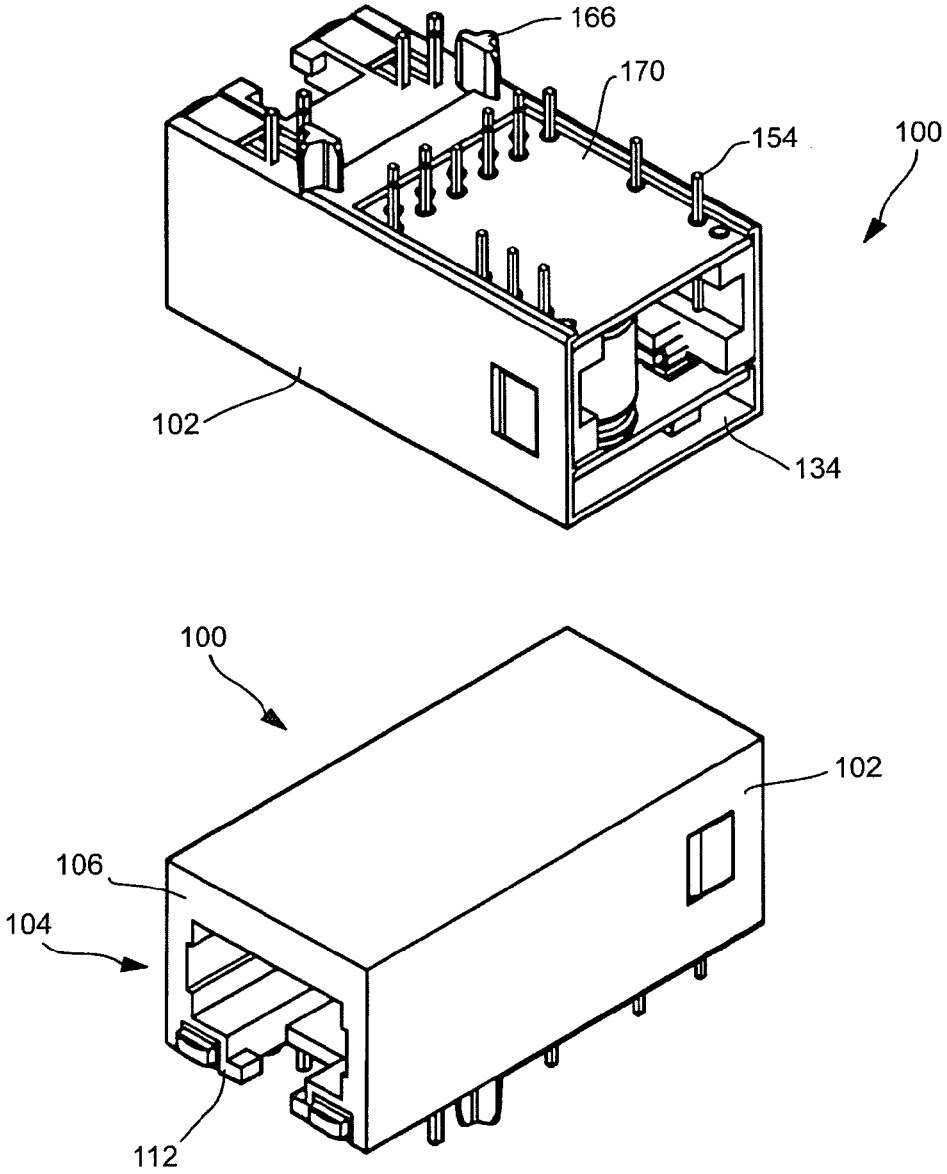
FIG. 1 is a front and rear perspective view of one embodiment of an assembled single port connector assembly in accordance with the principles of the present invention.

Reference is now made to the drawings wherein like numerals refer to like parts throughout.

It is noted that while the following description is cast primarily in terms of a RJ-type connector and associated modular plugs of the type well known in the art, the present invention may be used in conjunction with any number of different connector types. Accordingly, the following discussion of the RJ connectors and plugs is merely exemplary of the broader concepts.

As used herein, the terms "electrical component" and "electronic component" are used interchangeably and refer to components adapted to provide some electrical function, including without limitation inductive reactors ("choke coils"), transformers, filters, gapped core toroids, inductors, capacitors, resistors, operational amplifiers, and diodes, whether discrete components or integrated circuits, whether alone or in combination. For example, the improved toroidal device disclosed in U.S. Pat. No. 6,642,827 to McWilliams, et al. issued Nov. 4, 2003 entitled "Advanced Electronic Microminiature Coil and Method of Manufacturing" which is incorporated herein by reference in its entirety, may be used in conjunction with the invention disclosed herein.

As used herein, the term "signal conditioning" or "conditioning" shall be understood to include, but not be limited to, signal voltage transformation, filtering, current limiting, sampling, processing, conversion, regulation, distribution, and time delay.

As used herein, the term "integrated circuit (IC)" refers to any type of device having any level of integration (including without limitation ULSI, VLSI, and LSI) and irrespective of process or base materials (including, without limitation Si, SiGe, CMOS and GAs). ICs may include, for example, memory devices (e.g., DRAM, SRAM, DDRAM, EEPROM/Flash, ROM), digital processors, SoC devices, FPGAs, ASICs, ADCs, DACs, transceivers, and other devices, as well as any combinations thereof.

As used herein, the term "digital processor" is meant generally to include all types of digital processing devices including, without limitation, digital signal processors (DSPs), reduced instruction set computers (RISC), general-purpose (CISC) processors, microprocessors, gate arrays (e.g., FPGAs), Reconfigurable Compute Fabrics (RCFs), and application-specific integrated circuits (ASICs). Such digital processors may be contained on a single unitary IC die, or distributed across multiple components.

As used herein, the term "port pair" refers to an upper and lower modular connector (port) which are in a substantially over-under arrangement; i.e., one port disposed substantially atop the other port, whether directly or offset in a given direction.

As used herein, the term "IEEE Std. 802.3af" refers to any and all variants, drafts, request-for-comment (RFC) versions, revisions and supporting documentation or specifications/standards relating to the IEEE Standard 802.3af, entitled "IEEE Standard for Information technology, Telecommunications and information exchange between systems, Local and metropolitan area networks, Specific requirements, Part 3: Carrier Sense Multiple Access with Collision Detection (CSMA/CD) Access Method and Physical Layer Specifications Amendment: Data Terminal Equipment (DTE) Power via Media Dependent Interface (MDI)", each of the foregoing being incorporated herein by reference in its entirety.

As used herein, the term "Power Sourcing Equipment" or "PSE" refers generally to devices (such as, without limitation, those in accordance with IEEE Std. 802.3af or equivalent) which are adapted to deliver electrical power signals.

As used herein, the term "Powered Device" or "PD" refers generally to devices which are capable of being powered from another device, including without limitation over an Ethernet cable according to IEEE Std. 802.3af or equivalent. PD devices may include for example, without limitation, Wireless Access Points, IP Telephony devices, PDA recharging stands, portable test equipment and telecom power control devices.

As used herein, the term "interlock base" refers generally to a substantially insulating structure for use with electronic components, such as for example those disclosed in U.S. Pat. No. 5,015,981 to Lint, et al. issued May 14, 1991 entitled "Electronic microminiature packaging and method", U.S. Pat. No. 5,986,894 to Lint, et al. issued Nov. 16, 1999 entitled "Microelectronic component carrier and method of its manufacture", U.S. Pat. No. 6,005,463 to Lint, et al. issued Dec. 21, 1999 entitled "Through-hole interconnect device with isolated wire-leads and component barriers", U.S. Pat. No. 6,395,983 to Gutierrez issued May 28, 2002 entitled "Electronic packaging device and method", or U.S. Pat. No. 6,593,840 to Morrison, et al. issued Jul. 15, 2003 entitled "Electronic packaging device with insertable leads and method of manufacturing", each of the foregoing incorporated herein by reference in its entirety.

Figure 1A:
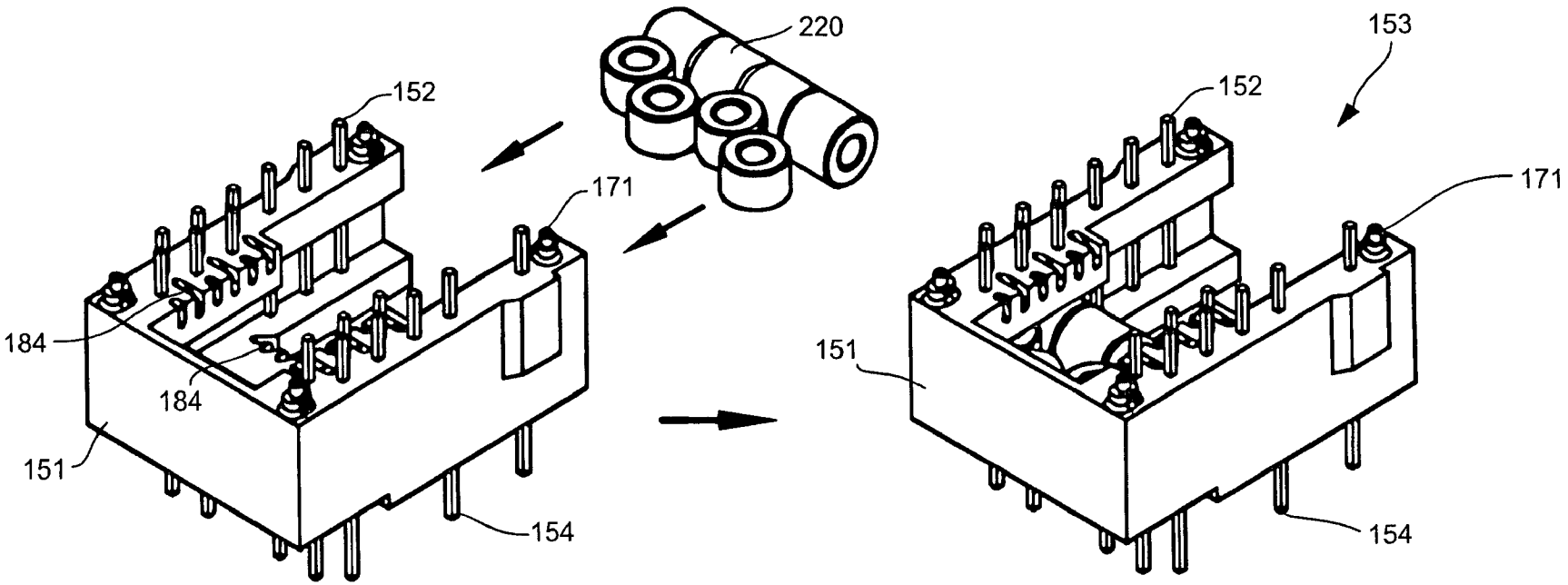
FIG. 1*a* is a front perspective view of the insert body element of the connector assembly of FIG. 1, showing various electrical components being inserted in the cavity thereof.
Figure 1B:
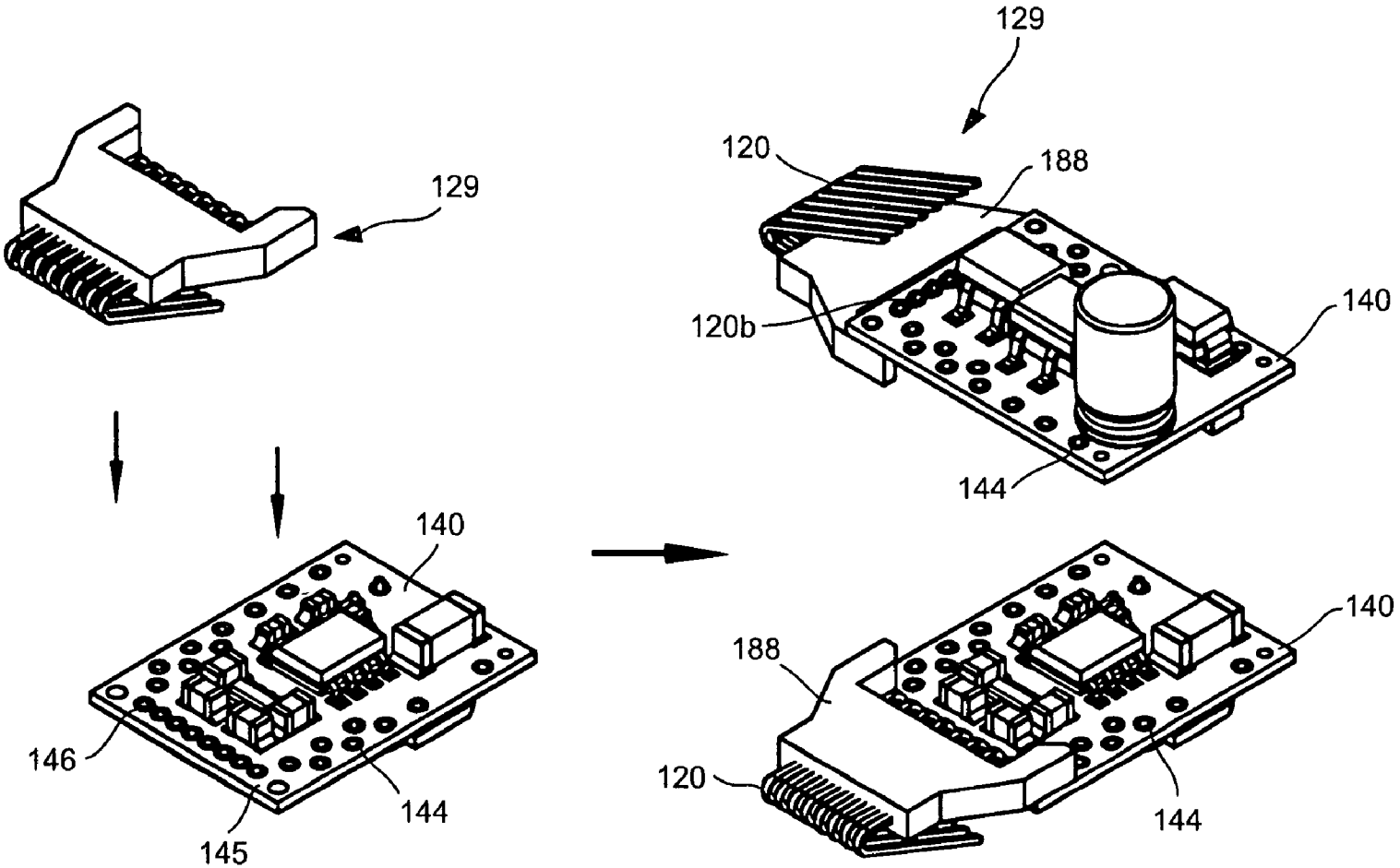
FIG. 1*b* is a top and bottom perspective view of the insulative header assembly of the connector of FIG. 1 being mounted to a substrate with electronic components mounted thereon.
Figure 1C:
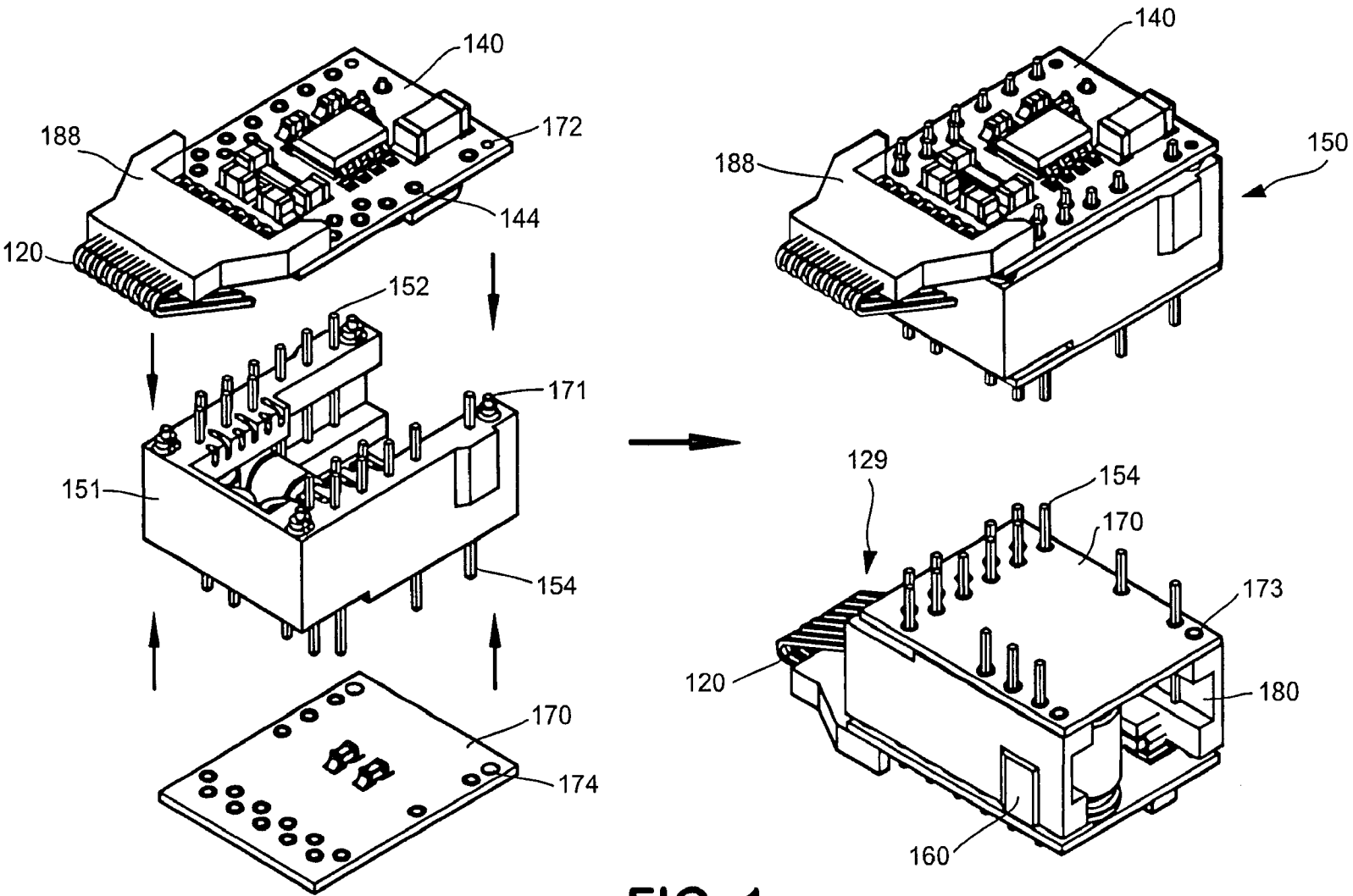
FIG. 1*c* is a top and bottom perspective view of the header-substrate assembly of FIG. 1*b* being mounted to the insert body element of FIG. 1*a*.
Figure 1D:
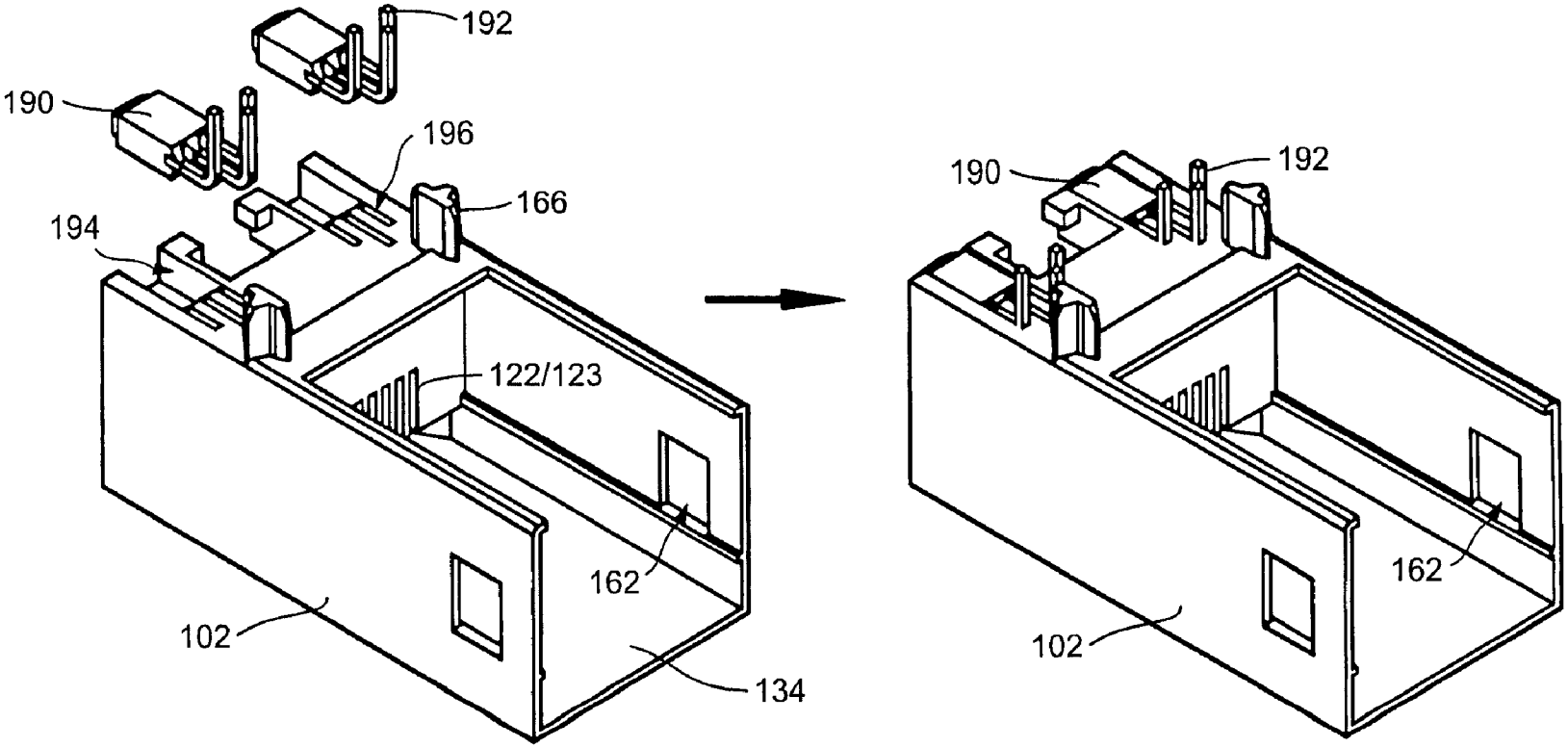
FIG. 1*d* is a perspective view of the connector housing element showing the bottom and back portions of the connector housing element such that the rear cavity is visible, as well as the optional installation of LEDs into the connector housing element.
Figure 1E:
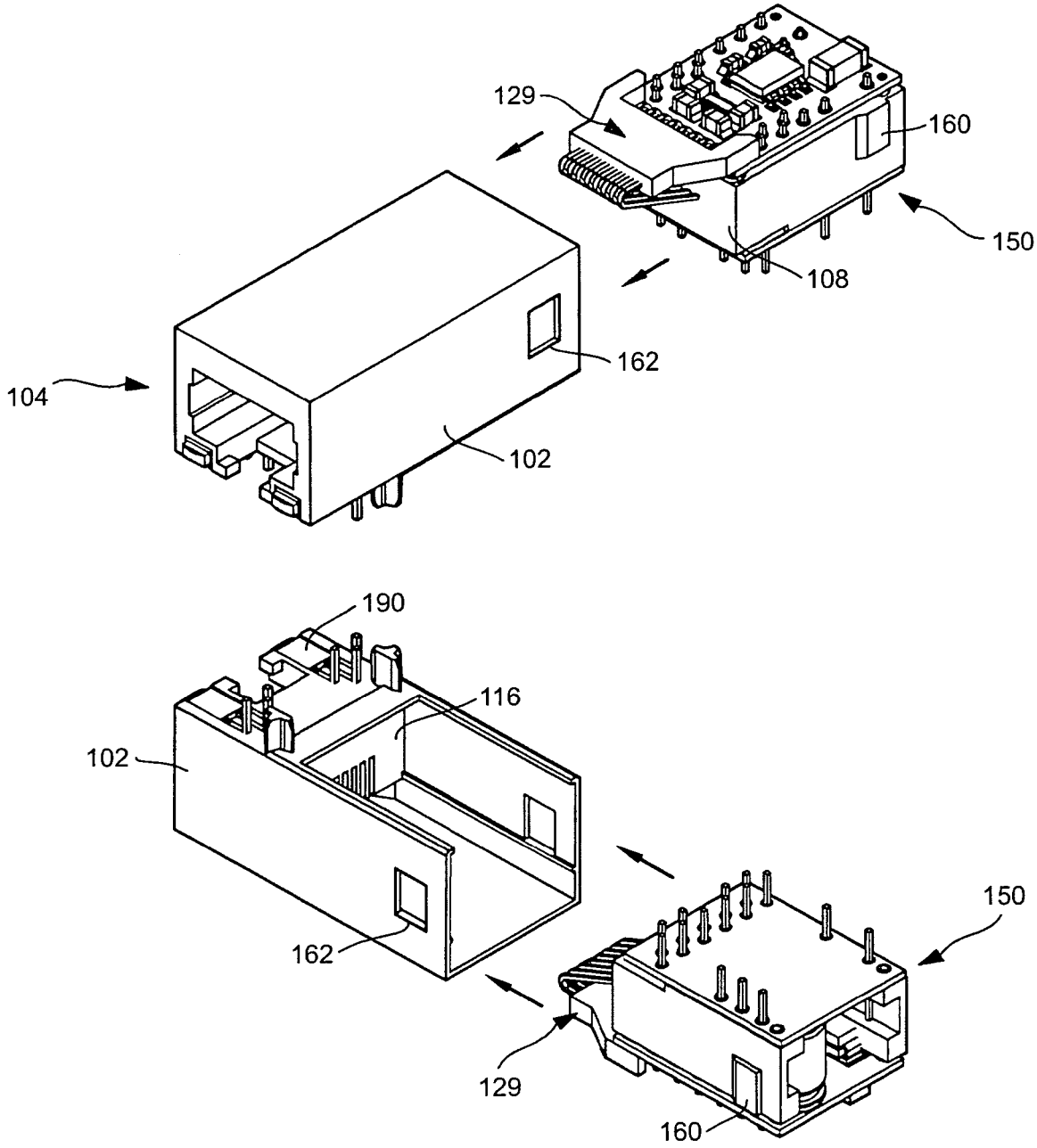
FIG. 1*e* is a top and bottom perspective view of the assembly of FIG. 1*c* being inserted into the connector housing element assembly of FIG. 1*d*.
Figure 1F:
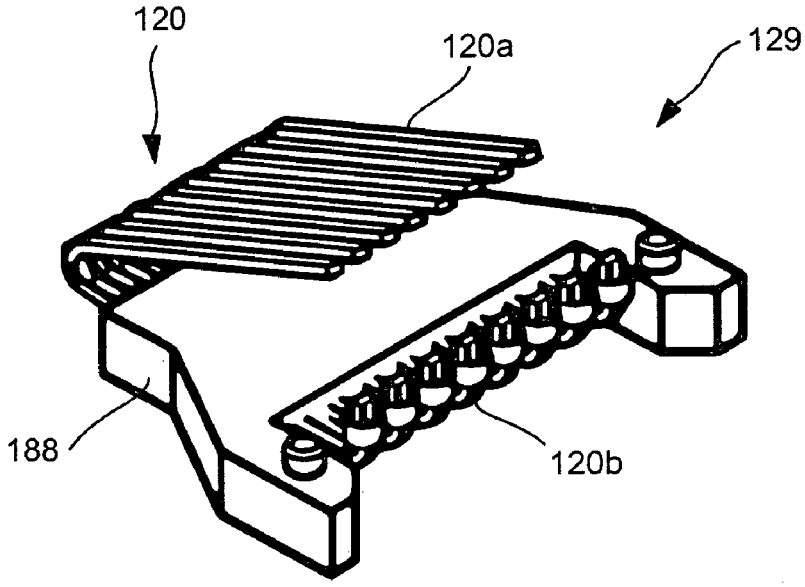
FIG. 1*f* is a perspective view of one exemplary embodiment of an insulative header assembly in accordance with the present invention.

Single-Port Embodiment Referring now to FIGS. 1-1*f*, a first embodiment of the connector assembly of the present invention is described. It will be appreciated that while described primarily in the context of an RJ-type modular jack (e.g., RJ-45 jack), the invention is in no way limited to such configurations, and may be more broadly applied to other types and form factors of connector.

As shown in FIG. 1, the exemplary assembly 100 generally comprises a connector housing element 102 having an individual connector 104 formed therein. The front wall 106 of the connector 104 is generally coplanar, such that a modular plug may be inserted into the plug recess 112 formed in the connector 104 without physical interference. Note also that as used herein, the term "front" is relative to the disposition of the connector. For example, in the context of a vertical mounted connector (not shown), the term front wall would more appropriately be described as a "top wall".

The plug recess 112 is adapted to receive one modular plug (not shown) having a plurality of electrical conductors disposed therein in a predetermined array, the array being so adapted to mate with respective conductors 120 present in the recess 112 thereby forming an electrical connection between the plug conductors and connector conductors 120, as described in greater detail below.

The connector housing element 102 in the illustrated embodiment is electrically non-conductive and is formed from a thermoplastic (e.g. PCT Thermex, IR compatible, UL94V-0), although it will be recognized that other materials including thermosets, polymers or otherwise, may conceivably be used. It is further recognized, however that a conductive or semi-conductive material may be used in certain applications, such as where the aforementioned conductors are otherwise insulated from the housing. In the illustrated embodiment, an injection molding process is used to form the housing element 102, although other processes may be used such as machining operations, transfer molding or die-casting processes, depending on the material chosen. The selection and manufacture of the housing element is well understood in the art, and accordingly will not be described further herein. The housing may also comprise a one-piece or multi-piece construction.

As is well understood in the connector arts the connector assembly may also be shielded with, inter alia, an external tin or alloy noise or Faraday shield (not shown). This shield may also be used for other purposes including, e.g., heat dissipation as described in greater detail subsequently herein.

As shown in FIGS. 1*d* and 1*e*, a plurality of grooves 122 are disposed generally parallel and oriented vertically within the housing 102, and are formed generally within the recess 112. The grooves 122 are spaced and adapted to guide and receive the aforementioned conductors 120 used to mate with the conductors of the modular plug. The conductors 120 are formed in a predetermined shape and held within an insulative header assembly 129 (e.g., of the "FCC" type in the illustrated embodiment), the latter also being received within the housing element 102 as shown in FIG. 1*e*. Specifically, the housing element 102 includes a cavity 134 formed in the back of the connector 104 generally adjacent to the rear wall and extending forward into proximity of the recesses 112, the cavity 134 being adapted to receive the header assembly 129. The first end of the conductors 120*a* of the substrate/component assembly 129 are deformed such that when the assembly 129 is inserted into its respective cavity 134, the upper conductors 120*a* are received within the grooves 122, maintained in position to mate with the conductors of the modular plug when the latter is received within the plug recess 112, and also maintained in electrical separation by the separators 123 disposed between and defining the grooves 122.

Further, the grooves 122 are adapted to "pre-load" the conductors 120 when the assembly is inserted such that a specified normal force will be applied to the modular plug when inserted into the recess 112.

It will also be recognized that while the illustrated embodiment of FIG. 1 comprises a "latch down" or "tab down" configuration (i.e., the removal tab for the modular plug is generally proximate the bottom of the connector 104), the present invention may be readily embodied in a "latch up" configuration.

Each cavity is further adapted to receive an electronics insert assembly 150 of the type generally shown in FIG. 1*c*.

Referring now to FIGS. 1*a*-1*c* and 1*e*, exemplary configurations of the (electronics) insert elements 150 are described in detail. As shown best in FIGS. 1*c* and 1*e*, the insert element assembly 150 includes an upper substrate 140, a lower substrate 170 and a plurality of upper terminals 152 and lower conductive terminals 154. The upper and lower terminals 152, 154 may be made unitary if desired (e.g., in a one-piece "pass through" configuration which traverses the thickness of the insert element body 151), or may comprise separate distinct components depending on the electrical configuration required. Alternatively, one or both sets of terminals (or even individual ones of the terminals within a set) can be configured in a different fashion, such as for example using a surface mount technique (e.g., akin to a ball grid array or BGA semiconductor package).

It will be appreciated that the terms "upper" and "lower" as used herein are meant in a completely relative sense, and are not in any way limiting or indicative of any preferred orientation. For example, where the connector assembly is installed on the underside of a substantially horizontal motherboard, the "upper" terminals would actually be disposed below the "lower" terminals. In yet another example, the connector assembly may be installed on the side of a substantially vertical motherboard, such that neither substrate is "upper" or "lower" in the relative sense.

The exemplary terminals shown in FIGS. 1*a*, 1*c* and 1*e* are insert-molded into the insert body element 151, although these may be fixed using an adhesive, inserted after molding (i.e. "post-inserted"), affixed via use of "staking", etc. Furthermore, the body element 151 may be formed using any number of processes such as those described in the discussion of the connector housing element 102 above, e.g., injection molding or transfer molding.

The upper substrate 140 includes a plurality of apertures 144 to receive the upper terminals 152, and may be populated on one or both surfaces with any manner of electronic components (whether discrete components such as resistors, capacitors, etc. or integrated circuits), conductive traces, etc. The upper substrate 140 also contains apertures 172 that are adapted to mate with complementary frictional or snap pins 171 on the insert body element 151. The upper substrate 140 may also include at least one internal conductive layer for use as shielding isolation, routing of conductive electrical pathways, etc. Such "multi-layer" substrates are well known in the art, and hence are not described in further detail herein.

The upper substrate 140 also includes a distal portion 145 which has a series (e.g., eight) of apertures 146 (e.g., in FCC arrangement) disposed such that the rear-most ends 120*b* of the conductors 120 of the FCC header assembly 129 can be inserted through these apertures as shown best in FIG. 1*b*. It is also appreciated that while a through-hole configuration is shown in the illustrated embodiment, a surface mountable configuration could also be used. The upper substrate 140 may be a single-layer board, or alternatively comprise a multi-layer board as previously discussed, as is well known in the electronic arts.

During assembly, the insert body element assembly can simultaneously be mated with a lower substrate 170 such as by using a set of complementary frictional or snap pins 173 on the insert body element 151 and holes 174 formed in the lower substrate. Alternative approaches to maintaining the relative alignment and position of the various components may be employed, including for example soldering the lower terminals 154 to their corresponding conductive apertures of the lower substrate 170, adhering the assembly to the substrate 170, or heat staking. Yet other approaches are possible, each being readily recognized and implemented by those of ordinary skill provided the present disclosure.

In the illustrated embodiment, the lower substrate 170 is disposed on the bottom face of the connector assembly 100 adjacent to the PCB or external device to which the assembly 100 is ultimately mounted. Each substrate 170 comprises, in the illustrated embodiment, at least one layer of fiberglass, although other arrangements and materials may be used, such as a "multi-layer" substrate as discussed with the upper substrate 140 above. The substrate 170 further includes a plurality of conductor perforation arrays formed at predetermined locations on the substrate 170 with respect to the lower conductors 154 of each insert assembly 150 such that when the connector assembly 100 is fully assembled, the conductors 154 penetrate the substrate 170 via respective ones of the aperture arrays. This arrangement advantageously provides mechanical stability and registration for the lower conductors 154 and provides means for providing electrical pathways between electronic components and/or the lower conductors 154.

Notably, the illustrated embodiments previously described also use a common configuration for the upper terminals 152 of the insert assembly 150, so that the upper substrate 140 which is disposed atop the insert assembly 150 need not be changed for each different insert assembly configuration. Hence, the exemplary connector assembly 100 can be configured as either a GBE or Gig-10e device, a 10/100 device, 802.3 PoE (see FIGS. 2*a* and 2*b*) or otherwise, simply by inserting a different configuration of the insert assembly 150 within the housing 102. This simplifies manufacturing, since the housing 102, header 129, insert body element 151, noise shields, etc. can be identical for each different variant; the only changes necessary relate to the electronic components 220, upper substrate(s) 140 and the lower substrate(s) 170. The apparatus and methods set forth in co-owned and co-pending U.S. patent application Ser. No. 11/170,583 filed Jun. 28, 2005 entitled "Universal Connector Assembly and Method of Manufacturing", which claims priority to U.S. Provisional Application No. 60/583,989 of the same title filed Jun. 29, 2004, each of the foregoing incorporated herein by reference in its entirety, may also be used consistent with the present invention to provide such "universal" configuration capability.

It is noted also that the electronics package utilized within the insert assembly 150 can be made to accommodate both variants (i.e., GBE/Gig-10e or 10/100) by the use of additional or extra electronic components (e.g., magnetics) to account for either use, and/or by making the electronics serve a dual-purpose where possible. Alternatively, individual ones of the insert assemblies 150 designed for GBE applications can be wired/equipped one way, and those destined for 10/100 applications wired/equipped another, since even the use of insert assembly body element 150 reduces manufacturing costs since only one type of insert assembly (albeit wired and equipped differently) is needed.

In the illustrated embodiments, one or more types of electronic components 220 are disposed within the interior cavity 180 formed within the insert assembly 150, including e.g., choke coils, transformers, etc. (see FIGS. 1*a*, 1*c*). These components have their wires in electrical communication with one or more of the upper and lower terminals 152, 154 of the assembly 150, such as via wire-wrapping, soldering, welding, or the like. A plurality of wire channels 184 are also optionally provided to aid in wire routing and separation. In the illustrated embodiment, the plurality of wire channels 184 are used to route wires to both the top and the bottom of the insert body element 151, thus providing means for a wire wrapped termination to both the upper and lower terminals 152, 154. The terminals 152, 154 may also be notched as is well known in the art to further facilitate bonding of the wires thereto.

Note that in the exemplary embodiment of FIG. 1*a*, the electronic components 220 are thermally isolated within the insert body element 151 such that the wire wrapped terminals 152, 154 may be mass terminated via, e.g., a solder dip or wave solder process. The electronic components may also be encapsulated within a potting compound or encapsulant such as epoxy or silicone gel, if desired for purposes such as improving electrical isolation and/or securing an orthogonal coil configuration for purposes of minimizing undesirable electrical interference or performance issues.

Furthermore, it will be recognized that while the insert body element 151 of the illustrated embodiment is formed as a unitary component (e.g., as a solid block of plastic or encapsulant) the insert body element may also be formed from two or more separate pieces accomplishing a similar functional result.

In another embodiment, an interlock base or comparable structure is used inside of the cavity 180 for, inter alia, additional electrical separation and to facilitate the mass termination of the electronic components.

The header assembly 129 is retained within the cavity 134 substantially by way of a sliding frictional fit with the housing element 102, although other methods and arrangements may be substituted with equal success. The illustrated approach allows for easy insertion of the completed terminal assembly 129 into the housing 102, sufficient locating of terminals 154 and posts 166 with respect to one another for placement on a parent device and subsequent selective removal if desired. Also, while shown in FIG. 1*b* that the header assembly 129 is substantially parallel with the upper substrate 140, it is appreciated that in certain applications it may be desirable for the header assembly 129 to be in other orientations including, e.g., substantially perpendicular to the upper substrate 140. This allows, for example, a vertical mounted connector assembly (as opposed to the horizontally mounted connector previously described).

Also as is best shown in FIG. 1*e*, the illustrated embodiment of the insert assembly 150 contains ramped locking snaps 160 on the insert assembly 150 which interlock with its respective receptacles 162 (FIG. 1*d*) on the connector housing element 102. The ramped locking snaps 160, when engaged into receptacles 162, restrict movement in all but one degree of freedom (with the lone remaining degree of freedom restricted by the insert assembly's 150 front wall 108 fit with the connector housing element 102 vertical surface 116). It is appreciated that a design restricting movement in more or less degrees of freedom is possible and configurations to accomplish these results are well understood in the art. Also it is contemplated that the ramped locking snaps 160 could be absent from the insert assembly 150 completely, and rather could be implemented for example on the terminal assembly 129.

FIG. 1*f* shows an exemplary embodiment of the construction of the header assembly 129, comprising a row of juxtaposed conductors 120 and an insulative header element 188. In the illustrated embodiment, the conductors 120 are insert-molded into the header element 188, the latter made from an injection-molded thermoplastic. Other techniques and materials could be used, such as for example a thermoset instead of the thermoplastic used in the illustrated embodiment. These alternatives and their design considerations, such as a known exposure to high-temperature for the product, are well understood by those possessing ordinary skill in the art and therefore will not be discussed further.

The embodiment of FIG. 1*f* uses insert-molded terminals (conductors) 120 of the type well known in the connector arts, although other arrangements can be used, including inserting the unformed leads into the sub-assembly 129 after the insulative header 188 has been formed and then subsequently forming the conductors 120. Also, as best shown in FIG. 1*f*, the exemplary conductors 120 are generally rectangular in cross section. This conductor shape is most often utilized when the conductors 120 are formed from a base material, such as phosphor bronze, which is generally flat and having a substantially uniform thickness. In other embodiments (not shown), the conductors can instead be formed from round wire, thereby having a generally circular cross section, or even with an elliptical or other shape.

The insert 129 could also be provided with optional locking mechanisms (not shown) to lock them into their channels within the housing 102, although this can also be accomplished using a frictional fit, heat staking, or another means. In addition the separator groove 122 features of the connector housing element 102 previously discussed could instead be implemented on the header assembly 129.

In the illustrated embodiment, the two ends of the conductors 120*a*, 120*b* for each header assembly 129 are disposed from a unitary conductor traveling through the insulative header 188, although this is by no means a requirement. It is appreciated that an electrical pathway from any one front end 120*a* of a conductor 120 may be connected to any other front end of a conductor 120 in certain configurations or in the alternative, any one distal end 120*b* of a conductor 120 may be connected to any other distal end of a conductor 120, inside or outside of the insulative header 188, etc.

As shown best in FIGS. 1*d* and 1*e*, the exemplary embodiment of the connector 100 also optionally includes one or more light sources 190 each comprising a set of conductors 192. While the illustrated embodiment of the present invention shows three conductors per light source, it is well understood in the art that this number could instead be two, etc. LED recesses 194 are formed within the housing element 102 which are adapted to receive at least a portion of the LEDs 190, wherein the LEDs would be retained by a frictional fit. It is appreciated that snap fits, heat staking, adhesives, etc. could also be used to accomplish a similar functional result. Note also that the LED recesses 194 within the housing element 102 may also be coated internally with a reflective coating of the type well known in the art to enhance the reflection of light energy radiated by the LED.

The housing element 102 also contains conductor recesses 196 which are intended to house at least a portion of the light source conductors 192 so that they are positioned accurately with respect to the housing posts 166. This feature is thus adapted to facilitate insertion of the connector as a whole onto the end customer parent device (not shown).

While in the illustrated embodiment the light sources 190 are shown at the bottom of the connector assembly, a similar configuration could be utilized wherein the light sources are placed within recesses at the top of the connector assembly. This may be desired when, e.g., the connector is in a tab up configuration (the illustrated embodiment shows a tab down configuration). Both tab up and tab down configurations are well understood in the connector arts and hence not described further herein. In addition where it is not desirable to have the light sources 190 located at the front end of the connector assembly, a light pipe assembly as is well understood in the art (not shown) could also be used in either configuration if desired. This light pipe may comprise, for example, one or more source LEDs disposed on or proximate to the motherboard or other device to which the connector is mated, or alternatively a light source within the connector itself (whether near the motherboard or otherwise). See, e.g., the light pipe arrangement of co-pending and co-owned U.S. patent application Ser. No. 10/246,840 entitled "Advanced Microelectronic Connector Assembly and Method of Manufacturing" filed Sep. 18, 2002, incorporated herein by reference in its entirety, which details one exemplary light pipe arrangement useful with the invention.

The two LEDs 190 used for the connector 100 radiate visible light of the desired wavelength(s), such as green light from one LED and red light from the other, although multichromatic devices (such as a "white light" LED), or even other types of light sources, may be substituted if desired. The underlying purpose of the LEDs is to provide an indication of the state of a device housing the connector assembly; therefore any number of configurations could be used to accomplish this result consistent with the present invention. Many other alternatives such as incandescent lights or even liquid crystal (LCD) or thin film transistor (TFT) devices are possible, all being well known in the electronic arts.

The connector assembly 100 with LEDs 190 may further be configured to include noise shielding for the individual LEDs if desired. In one embodiment, the LED shielding is accomplished by forming a thin metallic (e.g., copper, nickel, or copper-zinc alloy, etc.) layer on the interior walls of the LED recesses 194 (or even over the non-conductive portions of LED itself) prior to insertion of each LED. In a second embodiment, a discrete shield element (not shown) which is separable from the connector housing 102 can be used, each shield element being formed so as to accommodate its respective LED and also fit within its respective recess 194. In yet another embodiment, an external noise shield may be fabricated and deformed within the recesses 194 so as to accommodate the LEDs 190 on the outer surface of the shield, thereby providing noise separation between the LEDs and the individual connector conductors 120. A myriad of other approaches for shielding the connectors from the LEDs may be used as well if desired, with the only constraint being sufficient electrical separation between the LED conductors and other metallic components on the connector assembly to avoid electrical shorting.

Figure 1G:
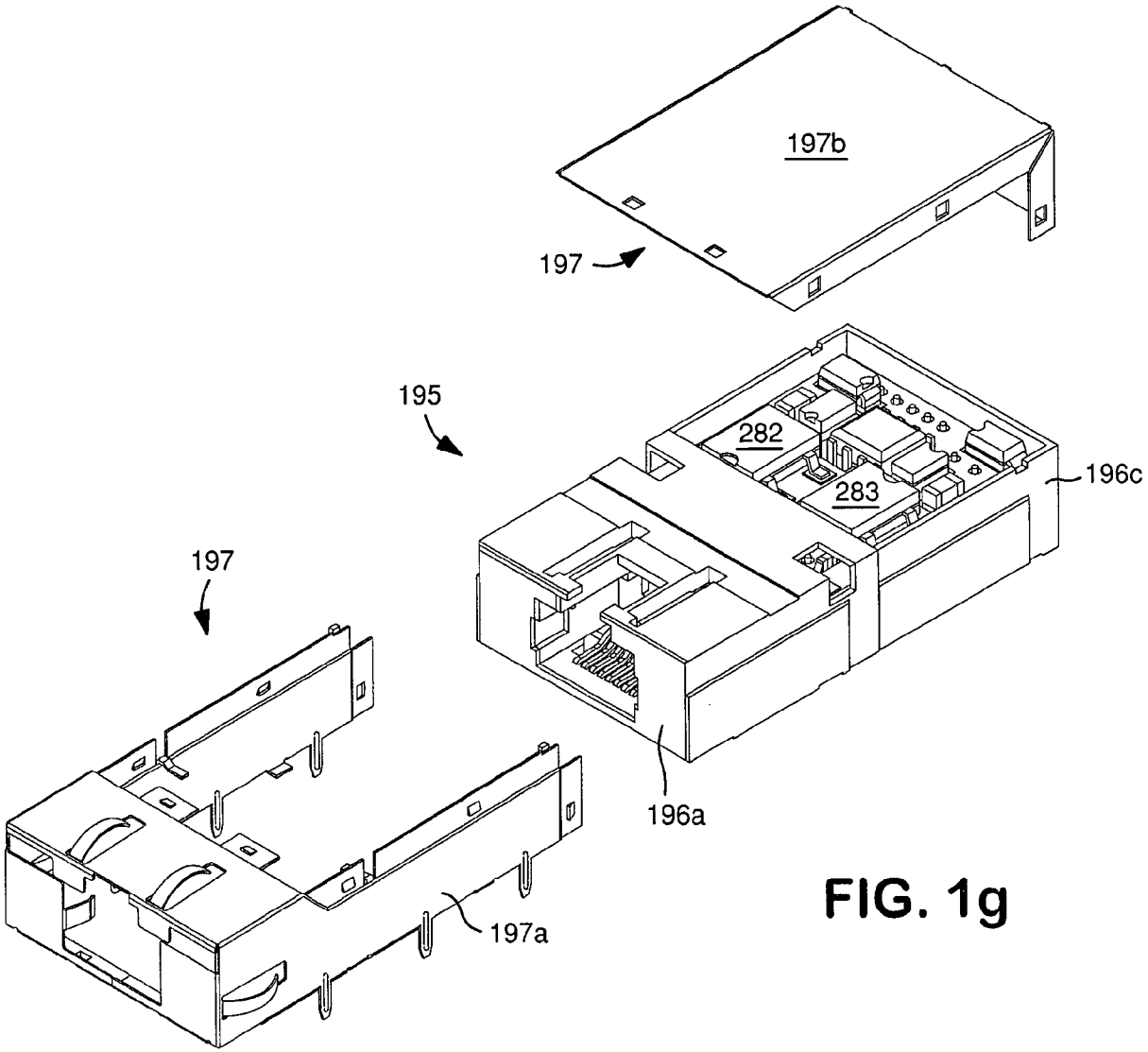
FIG. 1*g* is a top perspective view of another embodiment of the connector assembly of the invention, with external shield removed.
Figure 1H:
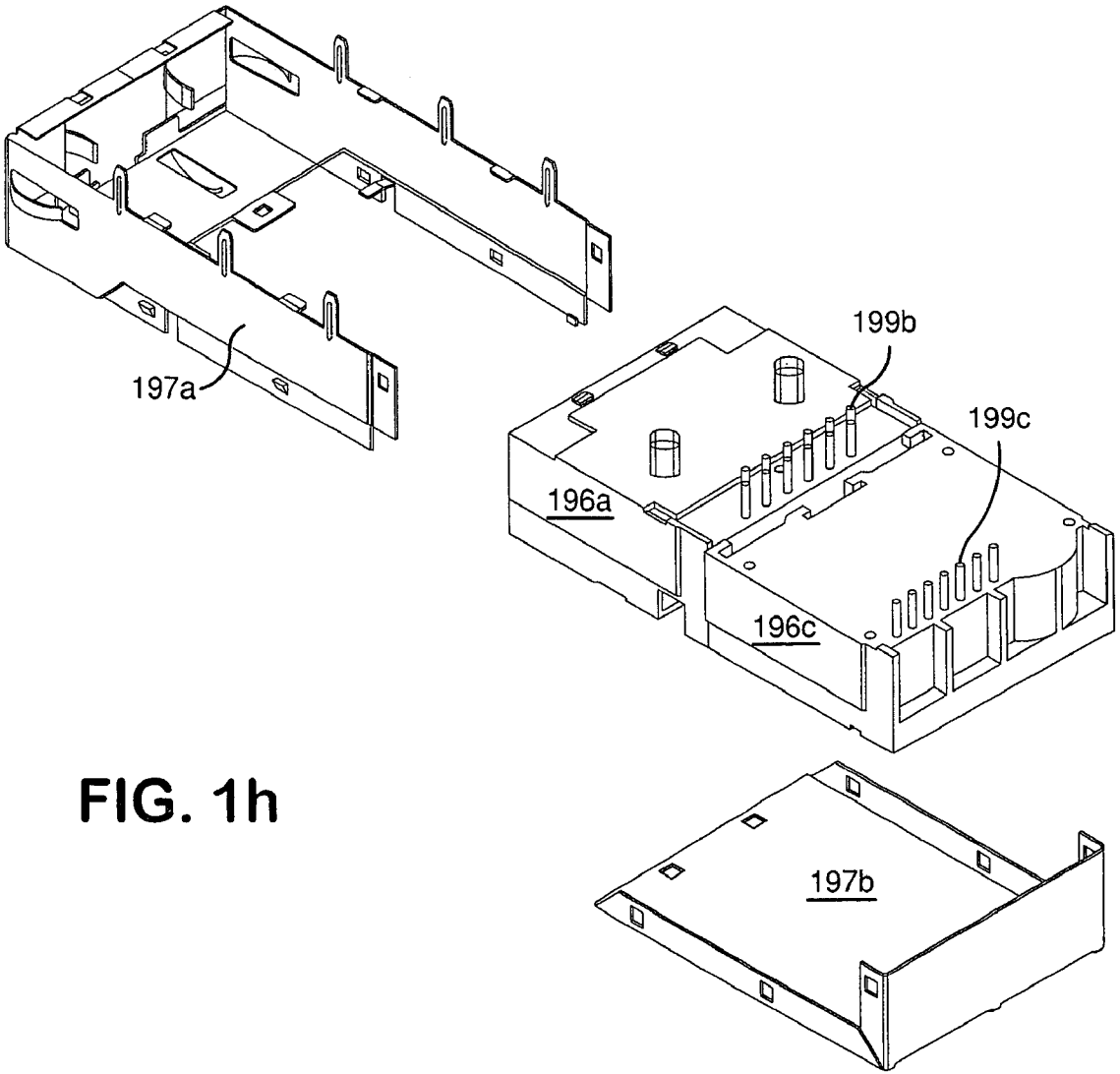
FIG. 1*h* is a bottom perspective view of another embodiment of the connector assembly of the invention, with external shield removed.
Figure 1I:
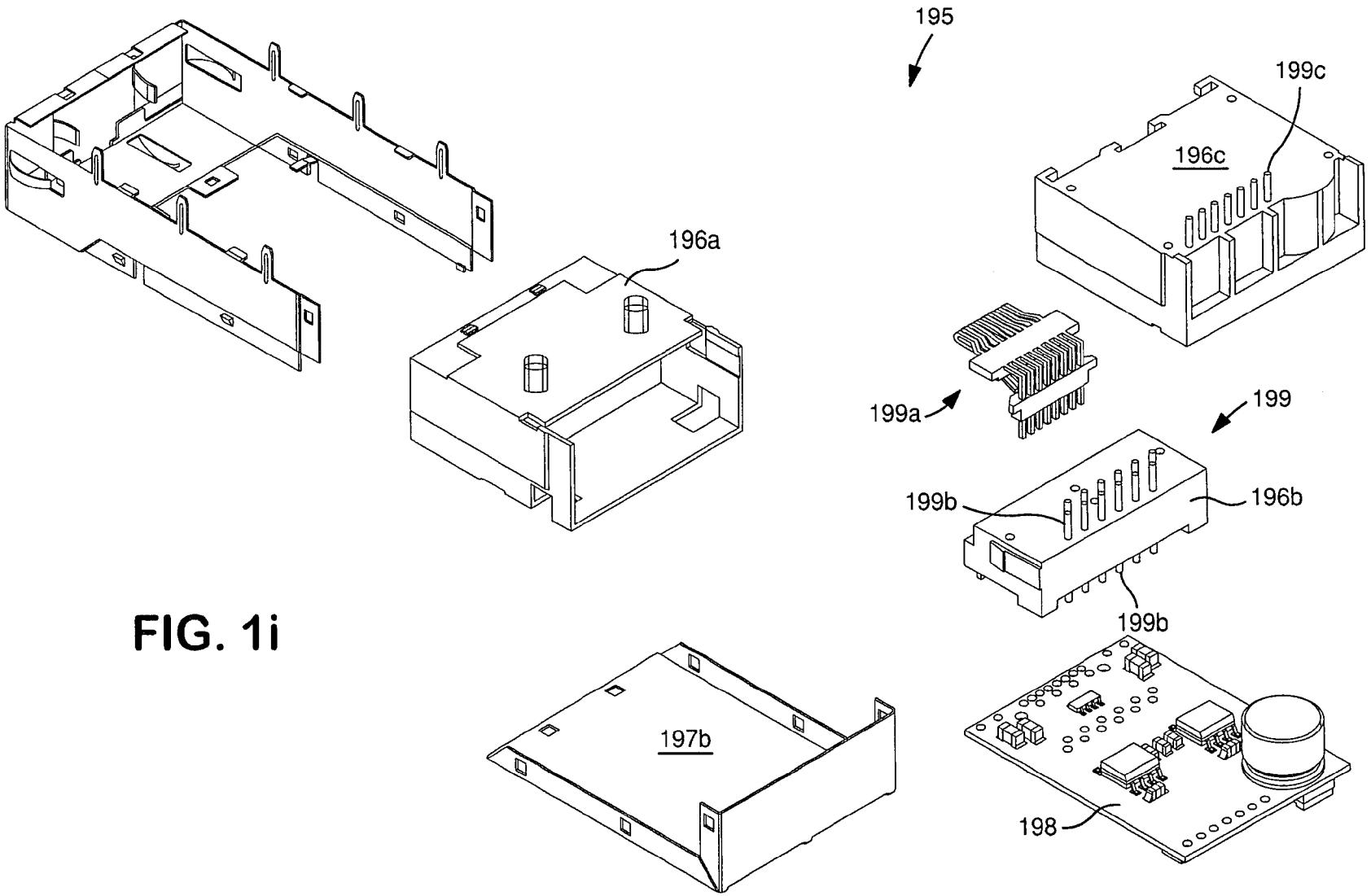
FIG. 1*i* is a bottom perspective partially exploded view of another embodiment of the connector assembly of the invention.

Referring now to FIGS. 1*g*-1*j*, yet another embodiment of the connector apparatus of the invention is described. As shown in FIG. 1*g*, the connector assembly 195 comprises a multi-part connector body 196 and multi-part external noise shield 197, although it will be appreciated that these components can comprise a greater or lesser number of constituent components. The multi-part body or housing comprises three (3) primary body elements 196*a*, 196*b*, 196*c* (as best shown in FIG. 1*i*), while the shield 197 comprises two (2) complementary external shield elements 197*a*, 197*b*.

The profile of the illustrated connector 195 has a width substantially greater than its height, although it will be appreciated that other form factors can be employed consistent with the invention. The greater width versus height is dictated largely by the use of a PCB or other substrate 198 in the rear portion of the connector 195, which is populated with several electronic components including multiple integrated circuits (including, e.g., the dual controllers 282, 283 of the circuit 280 of FIG. 2*c* described subsequently herein). Hence, where a single controller circuit (see FIG. 2*a*) is used, the width (and optionally depth) of the connector 195 can be reduced accordingly. Therefore, the illustrated connector assembly 195 may be configured with any variation of the power control circuitry described subsequently herein, depending on the desired application and required performance.

As shown best in FIG. 1*i*, the connector assembly 195 includes an internal lead and terminal assembly 199 comprising a lead element 199*a* (comprising, e.g., FCC leads), and a plurality of terminals 199*b* disposed within the intermediate housing element 196*b*. The leads and terminals mate with corresponding apertures in the substrate 198, thereby forming circuit path(s) including, inter alia, those from the leads through the various electronic components on the board and out through the terminals 199*b*.

An additional set of terminals 199*c* are disposed within the rear housing element 196*c* as best shown in FIG. 1*i*. These terminals are used to interface electrical components/traces on the substrate 198 to an exterior device such as a motherboard.

As best shown in FIG. 1*i*, the forward body or housing element 196*a* receives the intermediate body element 196*b* in an optional "snap-in" configuration. This snap-in feature registers the two elements 196*a*, 196*b*, and the substrate 198 (by virtue of its mating to the intermediate element 196*b*. The rear-most terminals 191 of the rear housing element 196*c* are also mated (such as via solder) to the substrate 198 through corresponding apertures formed therein, thereby registering the rear body element 196*c* to the substrate 198. Hence, when the connector assembly 195 is assembled (as shown best in FIG. 1*g*), the body elements 196*a*-*c* forms a substantially planar and rectangular assembly that is then received within the two shield elements 197*a*, 197*b*.

Also, its is noted that the exemplary configuration of FIGS. 1*g*-1*j* optionally uses no housing or body top surface as best shown in FIG. 1*g*. This "open-top" configuration allows for increased heat dissipation by removing that portion of the rear housing element 196*c* (typically formed from a thermally insulating polymer) from between the second shield element 197*b* and the heat producing components such as the controllers 282, 283. Additionally, a conductive heat transfer medium (e.g., silicone, epoxy, or even metallic components) may be used to place the heat-producing components within the rear body element 196*c* of the connector 195 in thermal contact with the rear or second shield element 197*b*, thereby making for more efficient heat transfer from the electronics to the ambient environment surrounding the connector assembly 195. This approach is particularly desirable in the exemplary configuration shown (i.e., when using the dual-controller circuit of FIG. 2*c*), since the power dissipation (e.g., 30 W) produces substantial heat during operation.

More specifically with regards to heat dissipation, one embodiment of the invention (see FIG. 1*k*) uses a thermal interface material (TIM) 230 to improve heat transfer between a heat generating component and the outside ambient environment (typically via a metallic noise or Faraday shield). The heat-generating component 232 may comprise literally any electronic component(s) that generates heat, including DC/DC converters, a PHY integrated circuit, bare die, or myriad other semiconductor devices; however the dual-controller circuit of FIG. 2*c* is particularly well suited for the application of a TIM material. The TIM may optionally be constructed from an alumina-filled fiberglass reinforced cured thermal gel or comparable material, although various alternatives appreciated by those of ordinary skill in the heat transfer arts could be readily substituted.

In one variant of the invention, a chip-on-board (COB) approach of the type well known in the art is used. As is known, COB is a high-density technology that integrates one or more bare semiconductor chips directly on to the interconnect substrate 236. In exemplary COB manufacturing, an unpackaged silicon die is attached directly onto the surface of a parent device (such as an FR4, flexible PCB or ceramic substrate) and wire bonded to form the requisite electrical connections. A coating (e.g., epoxy resin or a silicone coating) is then applied on top of the die to encapsulate and protect the die. Other benefits of COB ostensibly include: (i) high packing density; (ii) ability to mix standard assembly technologies; (iii) enhanced thermal characteristics; and (iv) may be adapted to high frequencies (higher than IC in a SMD package).

In power dissipating designs that utilize COB technology, the TIM 230 may act as a thermal transfer medium between a COB epoxy 234 and the external shield which subsequently transmits heat via convection to the ambient environment and/or simultaneously dissipates heat through the external shield interface present on the end product printed circuit board. COB technology has various other advantages including, inter alia: lower material costs as die packaging is obviated; internally mounted circuit board real estate savings due to the ability to route input and output traces at finer pitches than are realized when the dies are packaged; and the ability to utilize the COB epoxy to decrease high-potential (HI-POT) standoff distances.

It will also be recognized that the TIM 230 may be placed in direct contact with the electrical component (e.g., IC), thereby obviating the use of any epoxy or encapsulant 234. The TIM may also be flowed completely or partially around the electronic component(s) if desired, thereby allowing for heat flux passing through multiple outer surfaces of the component(s) to encounter the TIM (as opposed to air, which effectively acts as a thermal insulator).

In addition to the aforementioned heat transfer techniques already discussed, special coatings such as e.g. anodization can be applied to the external shield to further enhance heat transfer between the heat generating device and the external environment. Further, in another embodiment, perforations can be added to the shield in order to enhance airflow in and out of the device, whether this flow is enabled via natural or forced convection. In another embodiment, miniature "fins" or other comparable features can be incorporated into the external shield in order to increase surface area of the external shield further enhancing heat transfer efficiency. These may be used on other components as well. It is also appreciated that any of these techniques could be used alone or in combination with one another, depending on the heat dissipating requirements of the device.

Figure 1J:
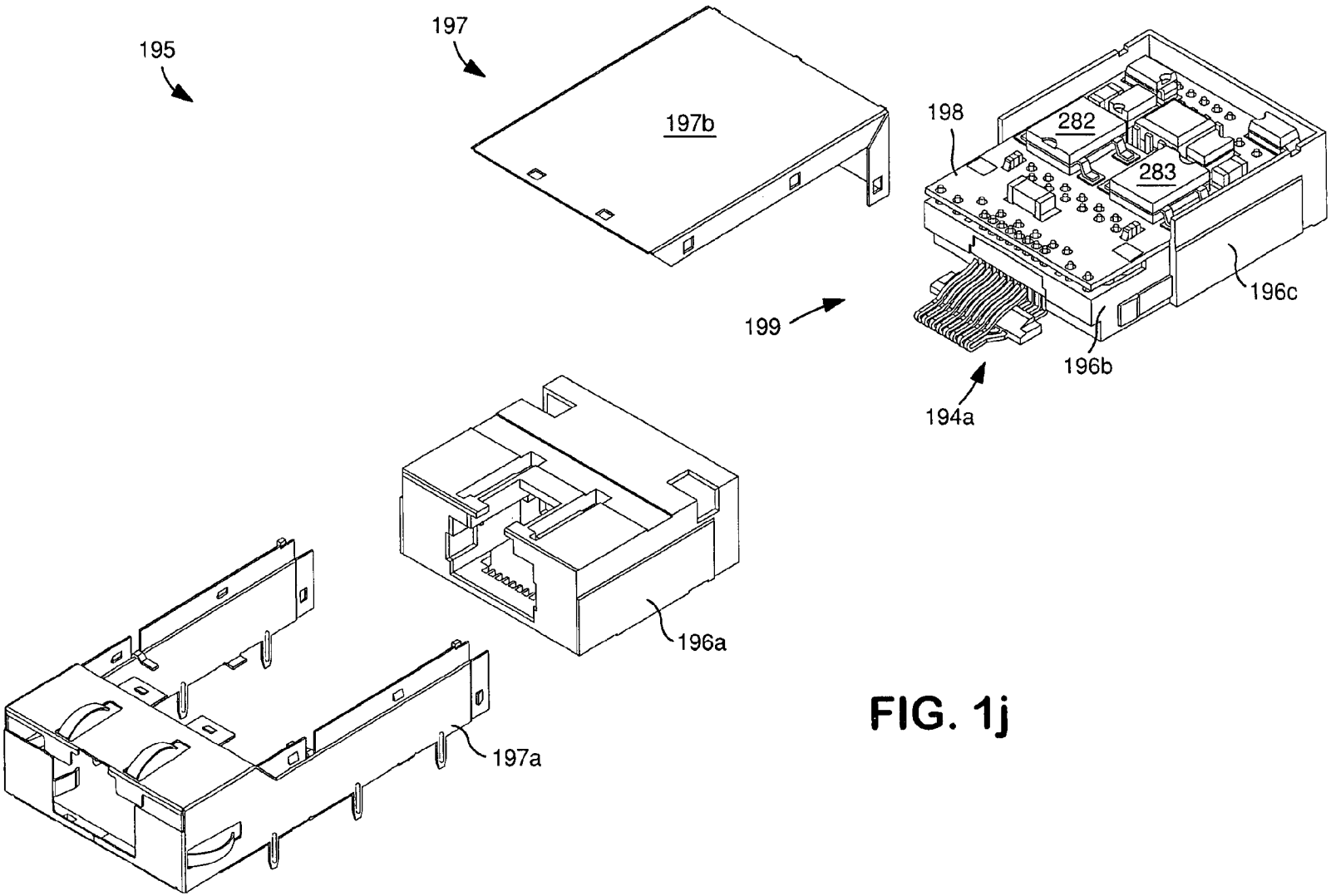
FIG. 1*j* is a top perspective partially exploded view of another embodiment of the connector assembly of the invention.
Figure 1K:
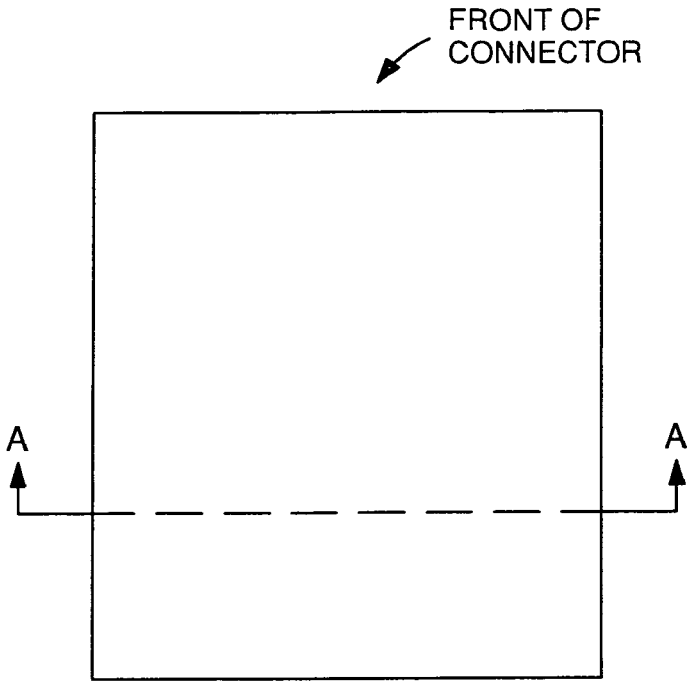
FIG. 1*k* illustrates a top view and an accompanying sectional view of an exemplary embodiment of the connector apparatus of the invention, illustrating an exemplary heat dissipation architecture and heat flows therein.
Figure 1K:
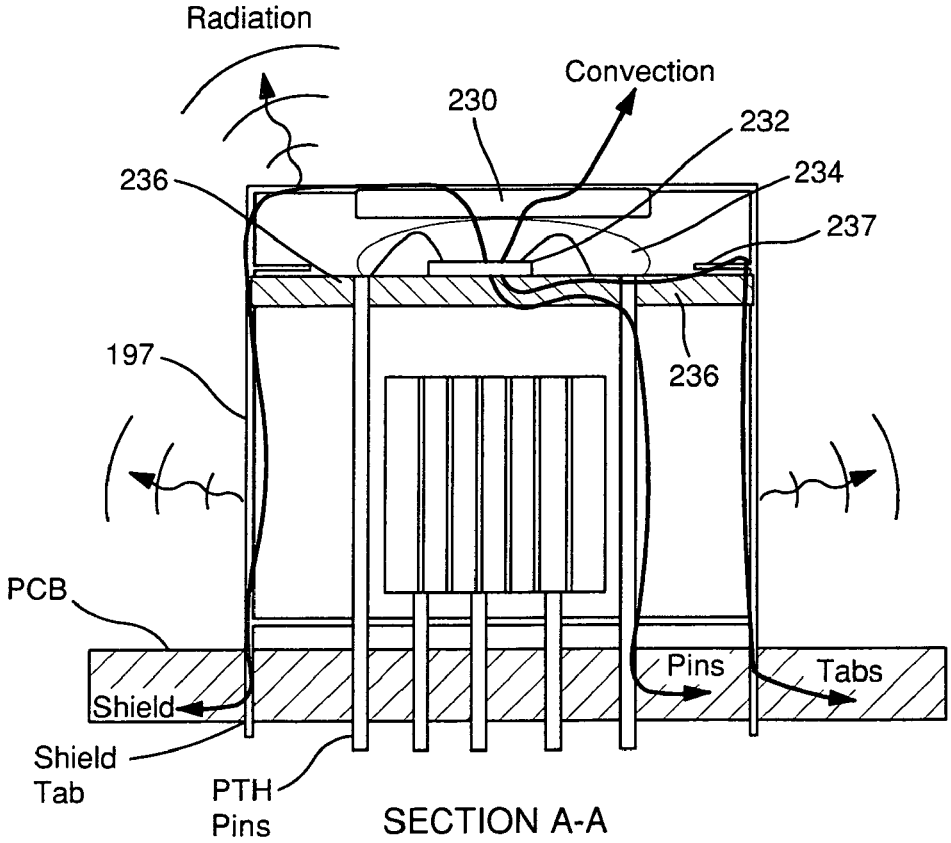

As shown in FIG. 1*k* there are at a minimum four (4) heat transfer paths that can be utilized either alone or in combination with one another, according to the principles of the present invention. These paths can, depending on the particular configuration chosen, make advantageous use of conductive heat transfer, convective heat transfer, and/or radiation (e.g., IR) heat transfer to varying degrees.

First, heat transfer can be removed from the heat generating device via an internal printed circuit board which can be located at virtually any position or orientation within the connector assembly. Tabs 237 located on the external shield 197 are mated to the internal substrate 236; this allows heat to flow from the heat generating device to the shield 197 and hence the ambient environment via convection and/or radiation. In addition, by varying the thickness of the copper cladding present on many printed circuit board designs, additional improvements in device heat transfer can be achieved.

Second, the heat generating device can advantageously dissipate heat via the internal printed circuit board 236 (i.e. the copper layer on the printed circuit board) to the external shield 197, and subsequently to the end product (parent device) printed circuit board or "motherboard" attached to the external shield via tabs on the lower edge of the shield 197 via conduction.

Third, a TIM 230 may be utilized to enhance transfer between a heat generating device and the external shield 197 (if installed) which can subsequently dissipate heat through the end product printed circuit board to which the device is mated, and/or by convection/radiation to the ambient.

Fourth, heat can flow through the terminals or pins 154 included within the connector primary signal paths (i.e., those mated to the internal substrate 236 and the motherboard, the latter which subsequently dissipates heat to other components and the surrounding ambient environment via conduction/convection/radiation).

Heat vents (e.g., "windows") located on, e.g., the upper surfaces of the connector body, and shield if desired, may also be utilized in order to further facilitate heat transfer via the release to ambient of heated air from within the device housing.

It will be appreciated that there may also be some heat flux through the shield 197 (and the exterior walls of the connector body due simply to conduction/radiation of the heated air within the internal volume of the connector (i.e., without a TIM or other such conduction path); however, due to the aforementioned insulating properties of air, this flux is generally minimal.

The aforementioned techniques can be utilized whether the heat generating device is a COB, a chip-scale package, a BGA package, discrete device, and whether or not the device is mounted on the relative bottom or top side of the internal printed circuit board 236.

It will be further appreciated that while a single-port device is shown in FIGS. 1*g*-1*j*, a multi-port device may also be readily fashioned. For example, in a "1×N" configuration, two or more of the connector assemblies shown in FIG. 1*g* can be mated in juxtaposed or side-by-side fashion. Alternatively, in a "stacked" configuration, multiple ports can be disposed atop one another in a "2×N" or similar configuration; see discussion of FIG. 4 herein for one possible approach that may be used (with proper adaptation to the general internal layout shown in FIGS. 1*g*-1*j*) to implement the internals of such a stacked connector assembly. Adequate heat rejection must also be considered in such an arrangement, such as by e.g., providing thermal conduction media between each set of heat-producing components and an adjacent radiating/convective surface such as an exterior surface of the noise shield.

It will also be appreciated that various types of additional shielding may be used consistent with the present invention, including inter alia, the connector assembly 195 of FIGS. 1*i*-1*j*. For example, the substrate, lateral, and vertical shield elements disclosed in U.S. Pat. No. 6,585,540 to Gutierrez, et al. issued Jul. 1, 2003 entitled "Shielded microelectronic connector assembly and method of manufacturing" may be used individually or in combination to provide additional noise/EMI shielding over that provided by the external noise shield described previously herein. These elements may also be used to dissipate thermal energy from the heat-producing components of the connector, such via direct or indirect physical contact. For example, in one variant, the internal noise shield element is also thermally coupled to a portion of a heat producing component as well as portions of the body element(s) 196, thereby allowing for heat dissipation directly into the housing. Alternatively (or in conjunction), the internal shield element can be physically/thermally coupled to the exterior shield 197, thereby Other configurations or approaches may be used as well.

Power Control Circuitry

Figure 2A:
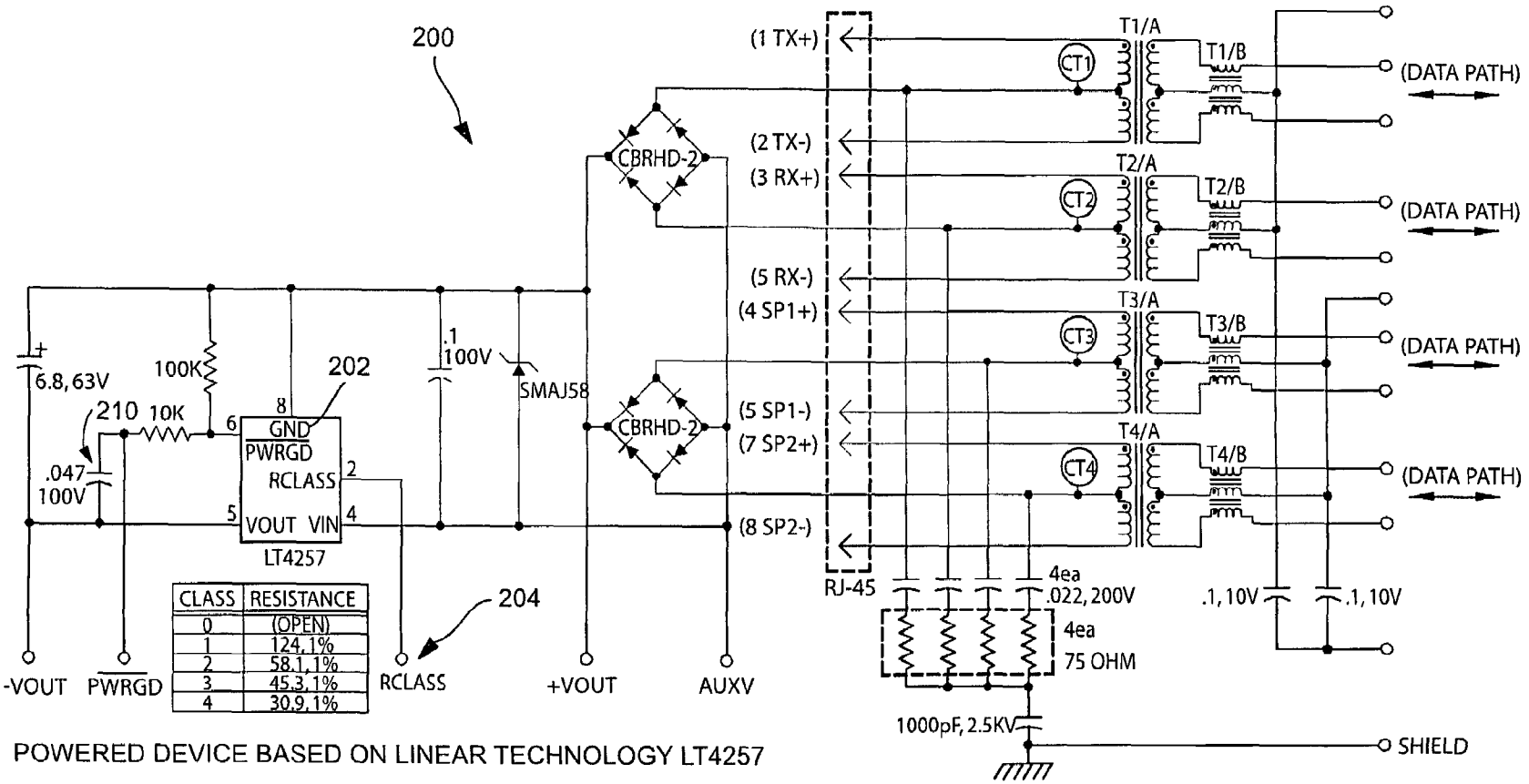
FIG. 2*a* is a schematic diagram illustrating a first exemplary embodiment of power control circuitry in accordance with the principles of the present invention, wherein an integrated interface controller is utilized.
Figure 2B:
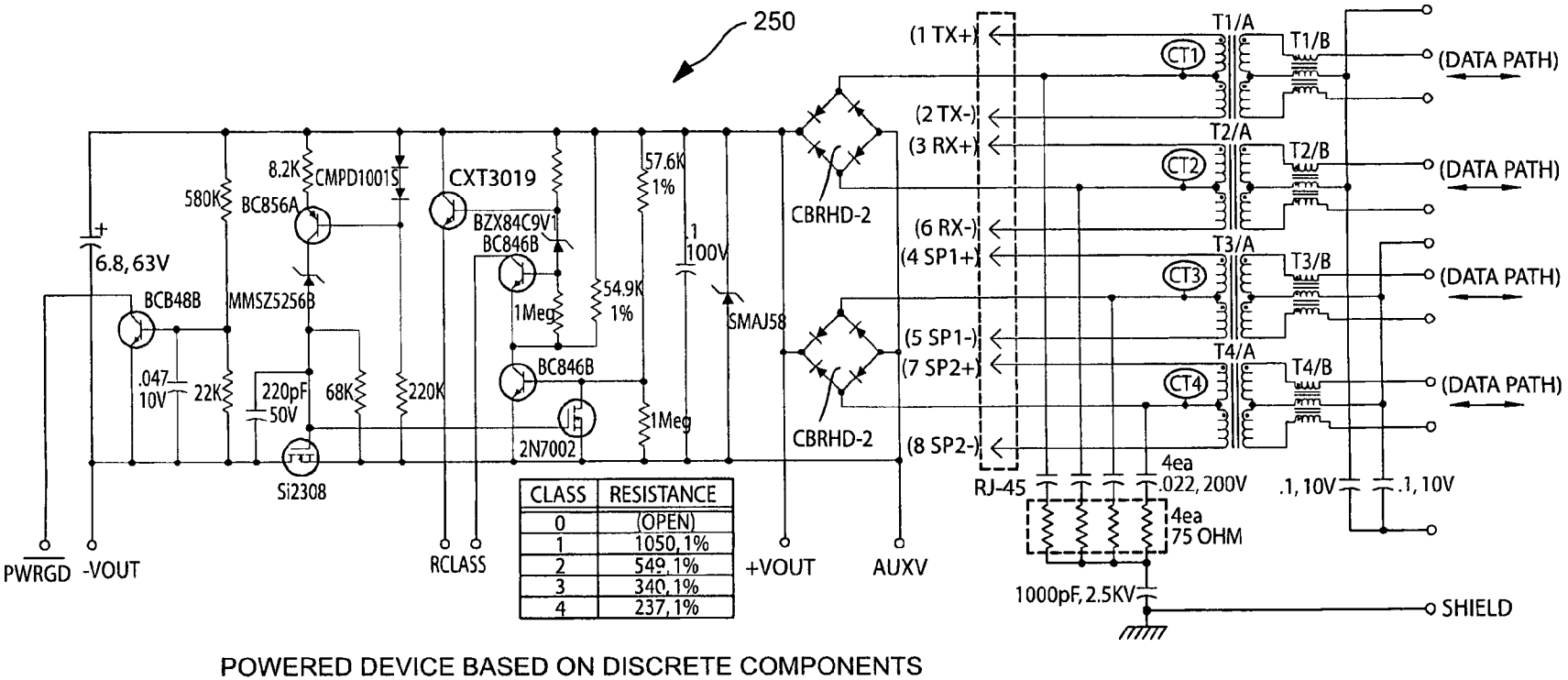
FIG. 2*b* is a schematic of another exemplary embodiment of the power control circuitry of the invention, wherein discrete components are utilized.
Figure 2C:
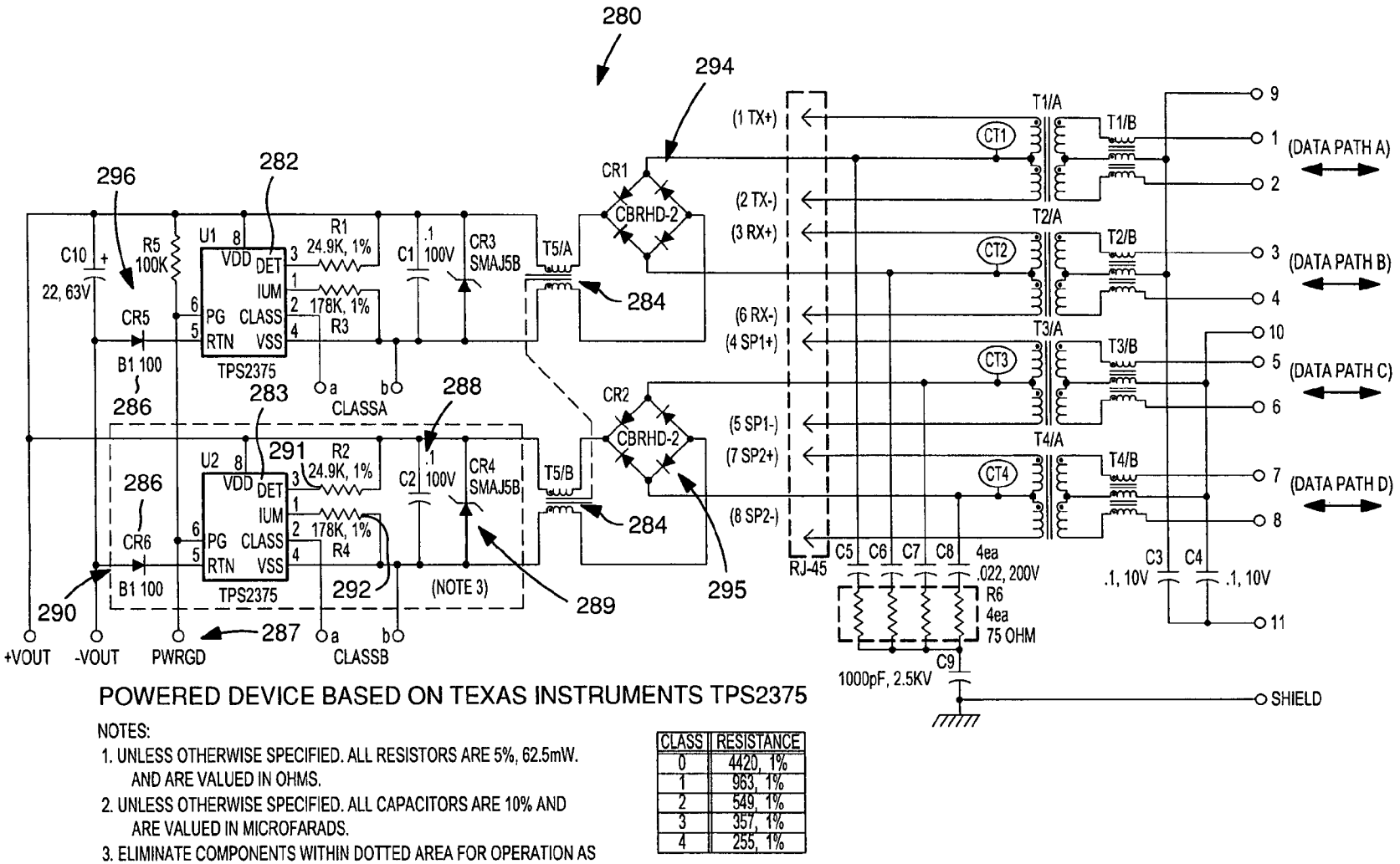
FIG. 2*c* is a schematic of another exemplary embodiment of the power control circuitry of the invention, wherein two integrated interface controllers, connected in a parallel arrangement, are used.

Referring now to FIGS. 2*a*-2*c*, exemplary embodiments of power control circuitry useful in the connector assembly 100 of FIGS. 1-1*f*, as well as other embodiments disclosed herein, are described in detail. This circuitry is useful for, e.g., receiving electrical power over a cable (e.g., a twisted pair wire and associated modular plug) and distributing or otherwise utilizing this power for various functions.

FIG. 2*a* illustrates a first embodiment of the circuitry 200, adapted for use in an RJ-type (here, RJ-45) modular connector such as that of FIG. 1. In the exemplary embodiment, the connector insert assembly 150 includes the power control circuitry 200, the latter designed to meet the requirements of the IEEE Std. 802.3af, and is intended for use as the front end of a "Powered Device" ("PD"). As is well known, IEEE Std. 802.3af, also referred to as "Power over Ethernet" (PoE), defines various standardized attributes of Ethernet power-sourcing equipment and powered terminals. The specification includes the delivery 48 VAC power over unshielded twisted-pair wiring. It is adapted to be compatible with an existing cable plant, including Category 3, 5, 5e or 6, without requiring modification.

In one variant, the power control circuitry 200 utilizes a PoE controller 202, such as for example the LTC4257 integrated circuit device manufactured by Linear Technology®. The exemplary power control circuitry 200, when connected to a powered Ethernet network, generally maintains itself in a disconnected state until the input voltage reaches a prescribed level. The power interface controller of this particular embodiment has several modes of operation, depending on the applied input voltage across the controller 202. These various modes are defined by the IEEE 802.3af standard, although it will be appreciated that other modes may be used alone or in combination with those of the IEEE Std. 802.af, compliance with the latter also not being a requirement of practicing the present invention. Specifically, one such operating mode comprises maintaining the device inactive when the input voltage with respect to ground is between 0V and −1.4V.

Another such mode comprises a "Signature Resistor Detection" (SRD) mode, which is entered at an exemplary voltage range of approximately −1.5V to −10V. During the SRD mode of the powered device (PD), the Power Sourcing Equipment (PSE) applies a voltage between −2.8V and −10V on the cable, and looks for a specific (i.e., 25kΩ) signature resistor. Exemplary PSE configurations are described in U.S. Pat. No. 6,764,343 to Ferentz issued Jul. 20, 2004 and entitled "Active local area network connector", which is incorporated herein by reference in its entirety. The circuitry 200 then responds to the applied voltage by connecting an internal 25k resistor between ground and the $V_{IN}$ pin of the controller 202, allowing the PSE at the other end of the cable to realize that a PD is present and desires power to be applied across the twisted pair cabling (or other interposed medium).

As noted above, there is a difference between the voltage necessary for the controller device 202 to operate in SRD mode and the voltage applied by the PSE. The reason for this difference is due to the fact that the power applied to a PD is allowed to use either of two polarities. Because of this, many variants of power control circuitry include the use of diode bridges (as shown in FIG. 2*a*) across the input between the RJ45 conductors 120 and the LTC4257. To compensate for the voltage drop across the diode bridges, the LTC4257 utilizes a slightly different range to detect the applied voltage coming from the PSE. While the use of the LTC4257 is exemplary, similar detection circuitry can be implemented discretely (as shown in FIG. 2*b*) and such circuitry is well understood by those of ordinary skill in the art to be implemented in any variety of ways.

Once the PSE has detected the signature resistor, the PSE then may optionally choose to determine the power classification of the device. In the illustrated embodiment of FIG. 2*a*, the power control circuitry 200, one or more of the power classifications set forth in IEEE Std. 802.3af (i.e., 0, 1, 2, 3, and 4) are utilized. Depending on the $R_{CLASS}$ resistance 204 implemented with the PD, the controller 202 (or discrete circuitry in the embodiment of FIG. 2*b*) will assert a load current in response to an applied voltage from the PSE (e.g., −15.5V to −20V). The PSE subsequently detects the load current, and is then able to classify the power rating of the PD. This functionality advantageously allows for a more efficient allocation of power across the network, by allowing the PSE to identify lower-power PDs and allocate less power accordingly.

It will be recognized that while IEEE Std. 802.3af contemplates five (5) different classification levels, other levels may subsequently be utilized, such as for a particular custom application. The circuitry 200 may readily be adapted by those of ordinary skill in accordance with the principles of the present invention to accomplish this result.

During this classification process (interval), a moderate amount of power is dissipated in the power control circuitry 200. IEEE Std. 802.3af limits this classification interval to 75 ms in order to prevent overheating of the circuitry. In an exemplary embodiment of the invention, thermal protection circuitry is implemented in order to protect the integrity of the control circuitry 200 should the "probing" process cause a preset thermal level to be exceeded (such as where the aforementioned 75 ms is exceeded for whatever reason). It will be appreciated that higher or lower intervals (and thermal thresholds) may be utilized consistent with the invention, based on the particular application. In such cases, appropriate changes can be made to the circuitry 200 in order to compensate accordingly.

In another embodiment of the power control circuitry 200, an under-voltage lockout (UVLO) circuitry is incorporated. In one exemplary embodiment based on IEEE Std. 802.3af, a maximum turn-on/tum-off voltage between 42V and 30V for the PD is implemented. In general, a PD is configured to maintain a substantial on-off hysteresis to prevent resistive losses from subsequently causing start-up oscillations. The UVLO circuitry of the illustrated embodiment accomplishes this by monitoring line voltage to determine when to apply power to the PD load. Before power is applied to the power control circuitry 200, the $V_{OUT}$ pin of the controller 202 is at high impedance and ground potential, since there is no charge on the capacitor 210 between $V_{OUT}$ and ground. When the input voltage rises above a UVLO turn-on threshold, the circuitry (controller) removes the classification load current and turns on an internal power MOSFET. The hysteretic UVLO circuit maintains the power applied to the load until the input voltage falls below the UVLO turn-off threshold.

In yet another embodiment of the power control circuitry 200, input current limiting circuitry is provided, wherein an onboard power MOSFET and sense resistor act to limit input currents to less than a specified limit (e.g., 400 mA maximum under IEEE Std. 802.3af). This allows, inter alia, the load capacitor to "ramp up" to the line voltage in a controlled manner. Because of the potential for a relatively large amount of power to be dissipated in the power MOSFET, the circuitry disclosed here may be designed to accept this thermal load and protect against damage to the power MOSFET should an overload condition arise.

In another embodiment, so-called "power good" circuitry is incorporated within the control circuitry 200 of FIG. 2*a*. In this embodiment, power good circuitry is used to indicate to the PD circuitry that the load capacitor for the PD circuit is fully charged, as well as the status of DC/DC conversion. The power good circuitry may also be adapted to various different applications (e.g., input voltage, PD power consumption, etc.). The design and implementation of such circuitry is readily accomplished by those of ordinary skill provided the instant disclosure, and hence not described further herein.

It is also noted that isolation transformers may be used consistent with the circuitry of FIG. 2*a*. Isolation transformers are important in many applications as they form a first line of defense against hazards that may exist on the line outside of a device (e.g., PD). Isolation transformers are designed to pass certain frequencies through their windings while rejecting others, and in this regard protect the circuitry 200 against unwanted signals from reaching device circuitry. These unwanted signals may result from, e.g., sources such as lightning strikes and/or various EMI sources.

Impedance matching transformer circuitry may also be utilized consistent with the invention. This function may be combined with the aforementioned isolation transformer, or alternatively comprise a separate component. The desired characteristic is the ability for the transformer circuitry, as a function of transformer turns-ratio and relative impedances on either side of the transformer, to match impedances between input and output.

Common mode magnetic circuitry may also be used. As is well understood in the electronic arts, it is desirable in networking circuitry to implement common-mode filtration in order to effectively block common-mode currents (i.e., currents that flow in the same direction) by presenting a high-impedance blocking pathway. Desirable differential mode signals travel in opposite directions and are thus allowed to pass freely through the common mode circuitry. The magnitude of the impedance seen by the common mode signal is a function of signal frequency and coil parameters (e.g., core permeability, cross-sectional area, etc.).

The design and implementation of isolation and impedance matching transformers and common mode circuitry are well understood by one of ordinary skill, and hence not described further herein.

FIG. 2*b* comprises a second embodiment of the control circuit 250, wherein the aforementioned controller 202 is obviated in favor of discrete transistor devices and other electronic components.

FIG. 2*c* illustrates a third embodiment of the invention. In this embodiment, the power control circuitry utilizes two controllers 282, 283 (e.g., PoE integrated circuits, such as the Texas Instruments® TPS2375 devices) connected in parallel. One salient distinguishing feature for this configuration allows the apparatus utilizing this circuitry to handle a higher power output. In the illustrated embodiment, an output power of 30 Watts is achievable (with maximum current input of 350 mA continuous) as opposed to the approximately 15 Watts available under the embodiments shown in FIGS. 2*a*, 2*b*. A 4-wire choke 284 between the two bridge rectifier outputs and the controller circuit's inputs may also be utilized, which is especially desirable for EMI suppression. Also, in the exemplary embodiment shown in FIG. 2*c*, the "power good" outputs 287 are advantageously tied together so that if either output is not available, "power good" status is not asserted. It will be appreciated, however, that other logical arrangements may be used consistent with the invention, such as for example where the two "power good" outputs are independent of one another, or coupled to logic which controls the common power good output under various states of the two constituent outputs of the controllers.

Another important characteristic of the exemplary circuit shown in FIG. 2*c* is the incorporation of Schottky rectifiers 286 that are tied to the output ports of the two controllers 282, 283, thereby inhibiting reverse current flow. Schottky rectifiers are well known in the art, and have the advantages of, inter alia, having very low forward voltage drop, as well as switching speeds that approach zero time. These features make these devices ideal for output stages of switching power supplies. This latter feature (i.e., short switching time) has also stimulated their use in very high frequency applications, including very low power applications involving signal and switching diode requirements of less than 100 picoseconds.

In another variant of the circuit 280 shown in FIG. 2*c*, components C2 288, CR4 289, CR6 290, R2 291, R4 292, and U2 283 can be removed and a jumper between CLASSA-b and CLASSB-b can be made, such that the circuitry disclosed can be backwards compatible with IEEE Std. 802.3af if desired.

It will also be recognized that while a dual-controller architecture is shown in the circuit 280 of FIG. 2*c*, the principles of the invention can be extended to embodiments with more controllers (e.g., three or more), such as in connector form factors other than the exemplary RJ-type (e.g., RJ 45) described herein.

It is further contemplated that power control circuitry with significant power output (e.g., power control circuitry shown in FIG. 2*c*) when utilized inside of a modular jack connector (such as for example those of FIGS. 1, 3, 4 herein) or any other configuration generating sufficient heat, will require a mechanism to dissipate any excessive heat generated by the circuit. As previously discussed, one exemplary embodiment of the present invention uses an external tin or alloy metal shield to advantageously dissipate thermal energy generated by the power control circuitry. The advantages of this configuration are two-fold. Often, the implemented design will require an external shield over the modular connector for EMI suppression irrespective of any heat dissipation requirements. Additionally, the external shield is a natural choice for dissipating heat, as the base material chosen (i.e., tin, copper, metal alloy, etc.) is typically a good conductor/radiator of heat. Because the shielding is already required in many designs, the added cost of adding the heat dissipation functionality of the present invention is often negligible.

Implementation of the heat dissipation functionality for the illustrated circuitry is readily accomplished by a wide variety of techniques well understood by those of ordinary skill. For example, the 2 bridge rectifiers 294, 295 and 2 Schottky rectifiers 290, 296 can be thermally coupled with the outer shielding by direct physical contact, or in the alternative an indirect coupling (via, e.g., copper traces on a printed circuit board) may be used as an intermediary heat transfer element, and/or a TIM such as that of FIG. 1*k* used. These choices may also be dictated by the overall design or specific design goals, such as circuit performance parameters (e.g., power consumption) as well as circuit layout.

In some embodiments the internal printed circuit board or substrate can incorporate a planar inductor design wholly or at least partly within the internal board itself, such as that disclosed by co-owned U.S. Pat. No. 6,628,531, the contents of which are incorporated by reference herein in their entirety, such as those devices utilizing a DC/DC converter. Such a design option adds further flexibility to an electronic circuit requiring an inductive device capable of being implemented in such a fashion.

The thermal coupling/dissipation capability of the invention is particularly important to prevent the overheating of heat-sensitive electronic components (such as integrated circuits) within the power control circuitry 280, as well as preventing exceeding the heat deflection and/or melting temperature of the surrounding polymer housing and components (resulting in physical damage to the mechanical elements and potential physical warping).

In another exemplary embodiment, thermal restricting features are implemented such that certain areas of the shield will dissipate significant amounts of heat, while other areas will remain comparatively thermally isolated from the internal power control circuitry. This is desirable where, for example, certain areas of the external shielding may be in close physical proximity to other heat-sensitive components. Techniques for accomplishing this functionality are well understood in the arts (e.g., such as those techniques employed with respect to printed circuit board substrates to facilitate soldering operations without "re-flowing" other components already soldered onto the substrate), and as such are not discussed further herein.

In another exemplary embodiment, a separate heat sink (not shown) can be used to absorb heat from the power control circuitry and dissipate this heat outside of the device (or into portions of the device itself). The heat sink will desirably be made from a good heat dissipating material such as copper or aluminum, and may even optionally be plated with another material, such as gold, on its outer surfaces to increase the thermal transfer of the device. Further, the heat sink can advantageously utilize "fins" of the type well known in the art, which increase surface area of the heat sink allowing faster dissipation of heat into the ambient environment.

Myriad other techniques are possible such as those discussed previously with regards to dissipating heat from a heat generating device to the ambient environment or to an end product printed circuit board.

Multi-Port Embodiments

In another embodiment of the connector assembly of the invention, a multi-port (i.e., 1×N, 2×N, etc.) device is provided. In one variant, a 1×N configuration is provided (see FIG. 3). As with the other embodiments described herein, LEDs or other light sources may or may not be included with the device 300 of FIG. 3, depending on the needs of the particular application.

Figure 3:
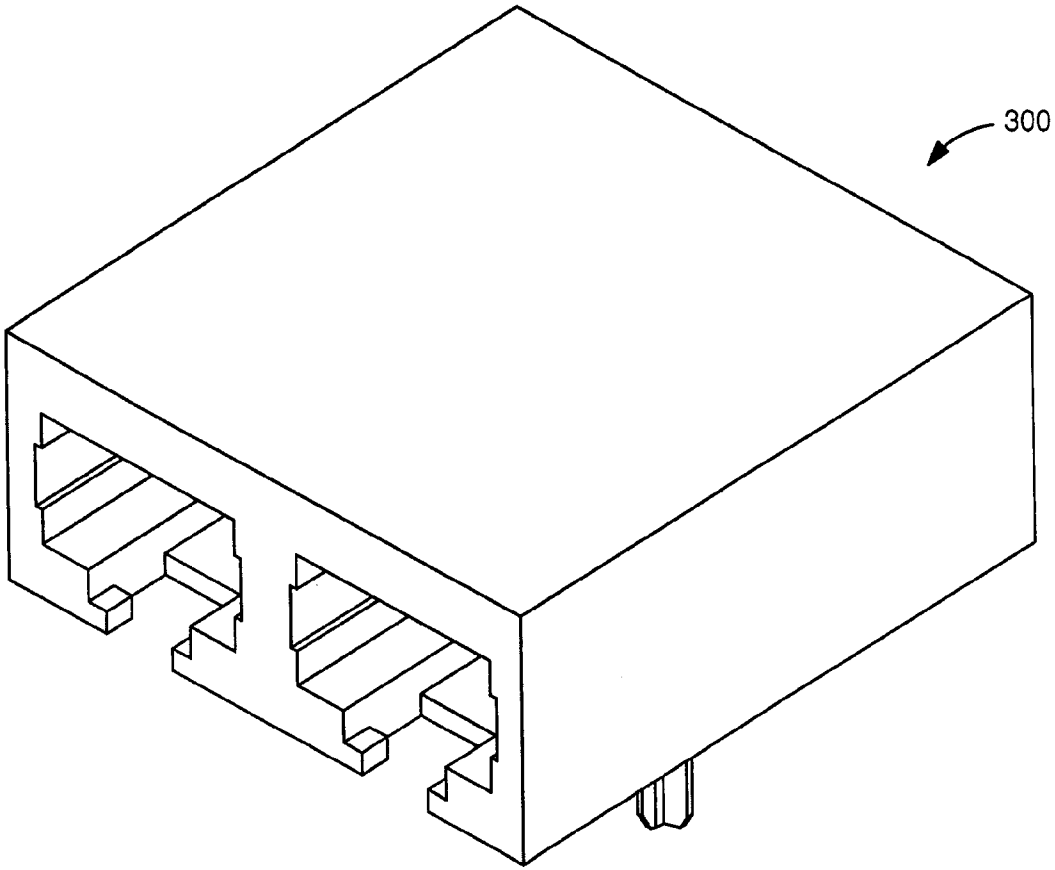
FIG. 3 is a front perspective view of another embodiment of the connector of the invention, wherein a "side-by-side" multi-port configuration is used.

In the connector assembly 300 of FIG. 3, the insert assembly 150 of FIG. 1 is here implemented so that each port has its own dedicated insert assembly (not shown), each assembly capable of being inserted into its respective port in the multi-port connector housing independent of the other assemblies.

Figure 4:
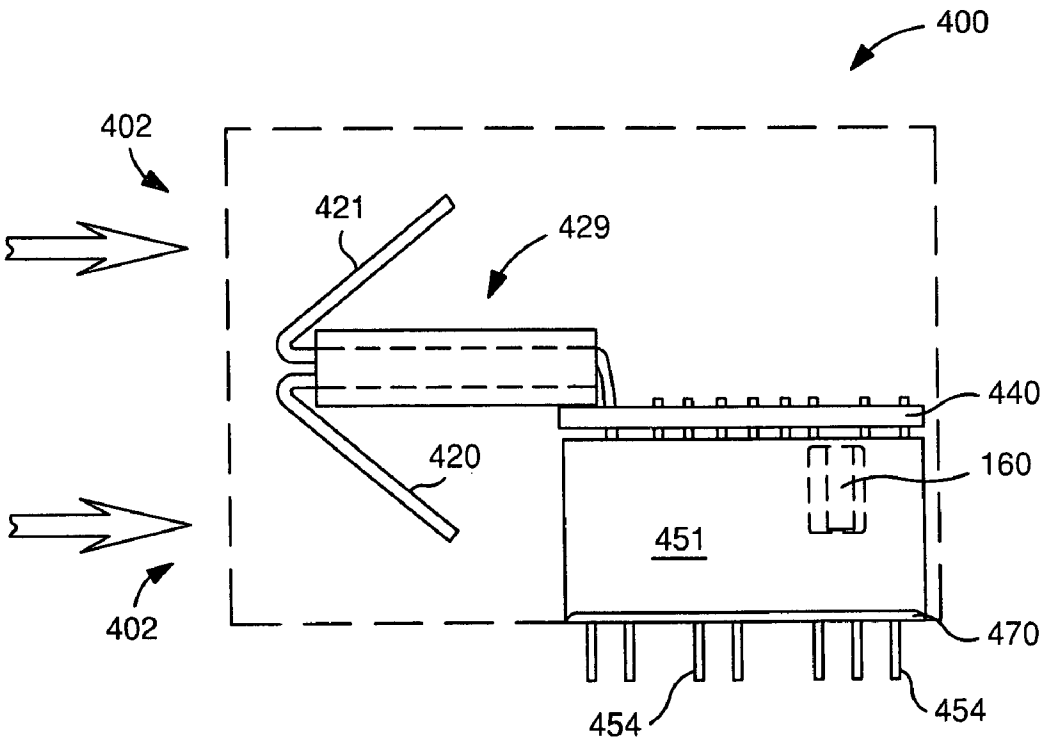
FIG. 4 is a side elevational view of another embodiment of the connector of the invention, wherein an "over/under" multi-port configuration is used.

In another variant of the invention (FIG. 4), a 2×N multi-port connector assembly 400 is provided, wherein multiple (i.e., at least two) ports 402 are present in the assembly in an "over-under" configuration. In the embodiment of FIG. 4, the header assembly 429 is modified so as to include a second set of conductors 421 (e.g., FCC leads) within the header element 488, which are in substantially mirror image disposition relative to the first set of conductors 420, yet terminated commonly to the first substrate 440. The additional electronics needed to support the second port in the port-pair and contained within the insert body 451, and/or on the upper and lower substrates 440, 470, each of the foregoing having sufficient room to accommodate the additional electronic components. Additional terminals 454 are also provided for mating of the second port to the motherboard or other parent device.

It will also be recognized in the context of multi-port embodiments that separators or EMI shields can be disposed between the conductor sets of any given header assembly 129 (or between adjacent ones of the juxtaposed assemblies 129) so as to minimize electrical noise and cross-talk between multiple header assemblies and their respective conductor sets 120 and/or between other components. For example, the multi-dimensional shielding apparatus and techniques described in U.S. Pat. No. 6,585,540 to Gutierrez, et al. issued Jul. 1, 2003 entitled "Shielded microelectronic connector assembly and method of manufacturing" and incorporated herein by reference in its entirety may be used consistent with the present invention, with proper adaptation. Other shielding configurations may also be used, the foregoing being but one option. Furthermore, other techniques well known in the electronic arts for minimizing EMI and/or cross-talk may be used consistent with the invention if desired.

Assembly

In another aspect of the invention, an improved electronic assembly utilizing the aforementioned connector assembly is disclosed. In one exemplary embodiment, the electronic assembly comprises the foregoing single port connector assembly 100 which is mounted to a printed circuit board (PCB) substrate having a plurality of conductive traces formed thereon, and bonded thereto using a soldering process, thereby forming a conductive pathway from the traces through the conductors of the respective connectors of the package. Similarly, the multiport embodiments of FIGS. 3 and 4 may be mounted to the substrate (e.g., PCB) to form the assembly.

In another embodiment, the connector assembly is mounted on an intermediary substrate, the latter being mounted to a PCB or other component using a reduced footprint terminal array. For example, the apparatus and methods described in co-owned U.S. Pat. No. 5,973,932 to Nguyen issued Oct. 26, 1999 entitled "Soldered component bonding in a printed circuit assembly", incorporated herein by reference in its entirety, may be used consistent with the present invention.

Method of Manufacture

Figure 5:
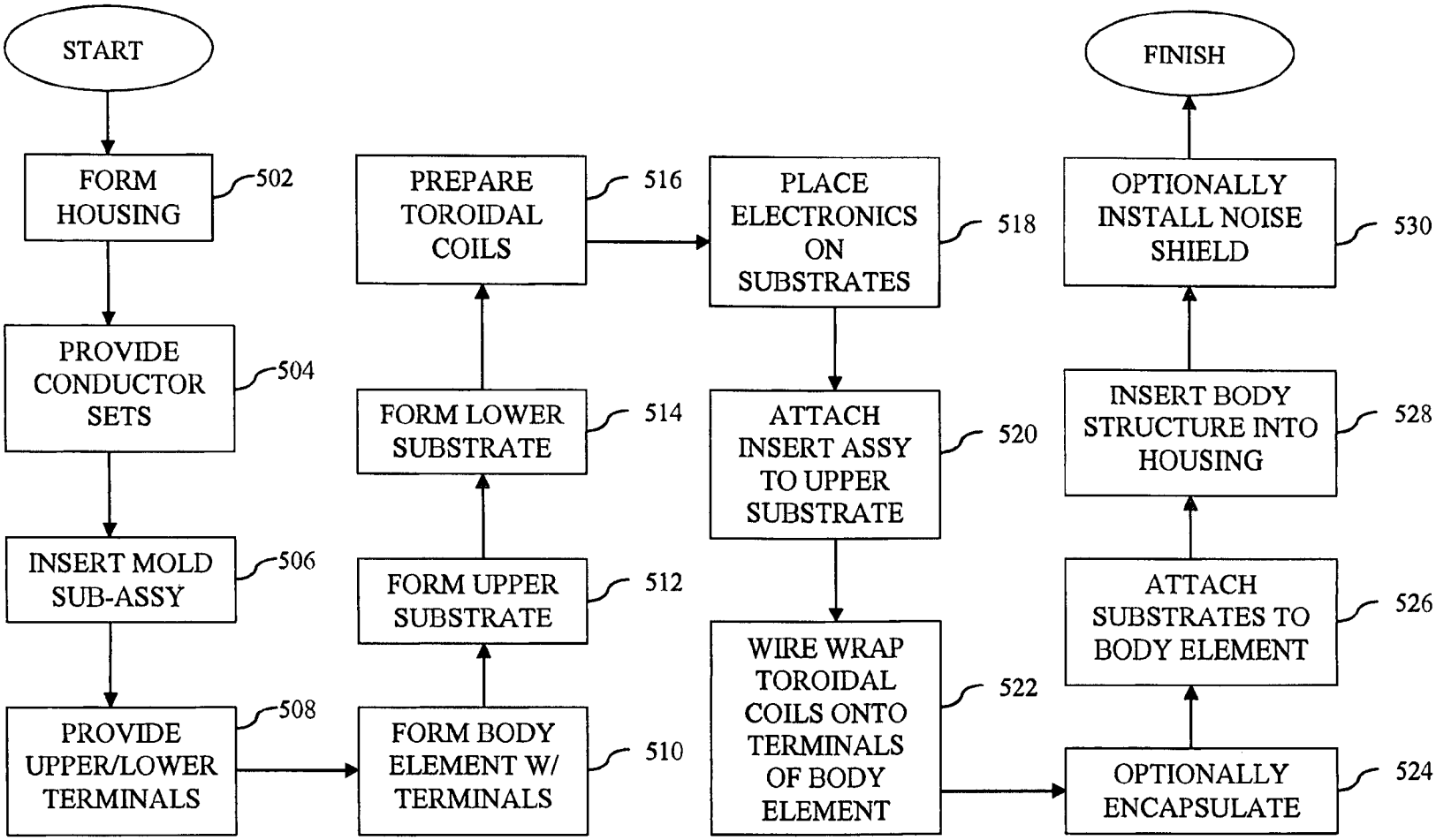
FIG. 5 is a logical flow chart showing one exemplary method for manufacturing the connector assembly according to the present invention.

Referring now to FIG. 5, the method 500 of manufacturing the aforementioned connector assembly 100 is described in detail. It is noted that while the following description of the method 500 of FIG. 5 is cast in terms of a single port connector assembly of FIG. 1*a*, the broader method of the invention is equally applicable to other configurations such as that of FIG. 1*g*-1*j*, and multi-port configurations.

In the embodiment of FIG. 5, the method 500 generally comprises first forming the assembly housing element 102 in step 502. The housing is formed using an injection molding process of the type well known in the art, although other processes may be used. The injection molding process is chosen for its ability to accurately replicate small details of the mold, low cost, accurate repeatability and ease of processing.

Next, a conductor set 120 is provided in step 504. As previously described, the exemplary conductor sets comprise metallic (e.g., copper, iron-nickel or phosphor-bronze alloy) strips having a substantially square or rectangular cross-section and sized to fit within the slots of the connectors in the housing 102.

In step 506, a first conductor set 120 is insert-molded within the respective portions of the header assembly 129, thereby forming the component shown in FIG. 1*f*.

In step 508, the upper and lower terminals 152, 154 are formed using similar methods to those used for the conductors 120, although in the illustrated embodiment the upper and lower terminals 152, 154 need not be deformed (i.e., can remain straight) if desired. Also while the conductors 120 are generally formed from a flat sheet of base material, the upper and lower terminals 152 and 154 can be generally formed from rectangular or circular wire stock, although either method may be appropriate depending on the circumstances. Note also that either or both of the aforementioned conductor sets may also be notched (not shown) at their distal ends such that electrical leads associated with the electronic components (e.g., fine-gauge wire wrapped around the magnetic toroid element) may be wrapped around the distal end notch to provide a secure electrical and mechanical connection.

In step 510, the body element 151 of the (electronics) insert assembly 150 is formed, such as via injection or transfer molding. In one embodiment, a high-temperature polymer of the type ubiquitous in the art is used to form the body element 151, although this is not required, and other materials (even non-polymers) may be used. The upper and lower terminals 152, 154 can either be insert-molded into the body element 151 or post-inserted, etc. after forming the body element 151.

Next, the upper substrate 140 is formed and perforated through its thickness with a number of apertures of predetermined size in step 512. Methods for forming substrates are well known in the electronic arts, and accordingly are not described further herein. Any conductive traces on the substrate required by the particular design are also added, such that necessary ones of the conductors, when received within the apertures, are in electrical communication with the traces.

The apertures within the upper substrate are arranged in two arrays of juxtaposed perforations, one at each end of the substrate, and with spacing (i.e., pitch) such that their position corresponds to the desired pattern, although other arrangements may be used. Any number of different methods of perforating the substrate may be used, including a rotating drill bit, punch, heated probe, or even laser energy. Alternatively, the apertures may be formed at the time of formation of the substrate itself, thereby obviating a separate manufacturing step.

Next, the lower substrate 170 is formed and is perforated through its thickness with a number of apertures of predetermined size in step 514. The apertures are arranged in an array of bi-planar perforations which receive corresponding ones of the lower conductors 154 therein, the apertures of the lower substrate acting to register and add mechanical stability to the lower set of conductors. Alternatively, the apertures may be formed at the time of formation of the substrate itself. Methods for forming substrates are well known in the electronic arts, and accordingly are not described further herein. Any conductive traces on the substrate required by the particular design are also added, such that necessary ones of the conductors, when received within the apertures, are in electrical communication with the traces.

In step 516, one or more electronic components, such as the aforementioned toroidal coils and surface mount devices, are next formed and prepared (if used in the design). The manufacture and preparation of such electronic components is well known in the art, and accordingly not described further herein.

The relevant electronic components are then mated to the upper substrate 140 and lower substrate 170 in step 518. Note that if no components are used, the conductive traces formed on/within the primary substrate will form the conductive pathway between the first and second sets of conductors 120 and respective ones of the upper conductors 152 and lower conductors 154. The components may optionally be (i) received within corresponding apertures designed to receive portions of the component (e.g., for mechanical stability), (ii) bonded to the substrate such as through the use of an adhesive or encapsulant, (iii) mounted in "free space" (i.e., held in place through tension generated on the electrical leads of the component when the latter are terminated to the substrate conductive traces and/or conductor distal ends, or (iv) maintained in position by other means. In one embodiment, the surface mount components are first positioned on the primary substrate, and the magnetics (e.g., toroids) positioned thereafter, although other sequences may be used. The components are electrically coupled to the PCB using a eutectic solder re-flow process as is well known in the art.

In step 520, the header assembly 129 is attached to the upper substrate 140. The distal ends 120*b* of the conductors 120 are inserted through the respective apertures 146 of the upper substrate 140. The distal ends 120*b* are then bonded to the substrate contacts such as via soldering or welding to ensure a rigid electrical connection for each.

In step 522, the remaining electrical components are disposed within the cavity of the insert assembly 150 and wired electrically to the appropriate ones of the upper and lower terminals 152, 154. This wiring may comprise wrapping, soldering, welding, or any other suitable process to form the desired electrical connections.

In step 524, the electronic components of the assembly 150 are optionally secured with silicone or other encapsulant, although other materials may be used. This completes the insert assembly sub-structure 153.

In step 526, the assembled upper substrate 140 with SMT/magnetics and lower substrate 170 is mated with the insert assembly sub-structure 153 and its components, specifically such that the upper terminals 152 are disposed in their corresponding apertures of the substrate 140 and the lower terminals 154 are disposed in their corresponding apertures of the substrate 170. The terminals 152, 154 are then bonded to the substrate contacts such as via soldering or welding to ensure a rigid electrical connection for each. The completed insert assembly may be optionally electrically tested in process to ensure proper operation if desired either before or after step.

Next, the completed insert structure of step 528 is inserted into the housing and snapped into place, thereby completing the (unshielded) connector assembly.

Lastly, in step 530, the external noise shield (if used) is fitted onto the assembled connector 100, and the various ground straps and clips are positioned so as to provide grounding of the noise shield.

With respect to the other embodiments described herein (i.e., single connector housing, connector assembly with LEDs or light pipes, etc.), the foregoing method may be modified as necessary to accommodate the additional components. Such modifications and alterations will be readily apparent to those of ordinary skill, given the disclosure provided herein.

It will be recognized that while certain aspects of the invention are described in terms of a specific sequence of steps of a method, these descriptions are only illustrative of the broader methods of the invention, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. A connector assembly adapted to receive power over twisted pair cabling, comprising:

a connector housing comprising a recess adapted to receive at least a portion of a modular plug;

a first set of conductors disposed at least partly within said recess and adapted to interface electrically with said plug; and a removable insert element comprising a first substrate and a second substrate comprising a plurality of electrically conductive pathways associated therewith, and at least one insert element comprising a plurality of electronic components disposed substantially therein; and a heat dissipation apparatus, said heat dissipation apparatus comprising:

a circuit comprising one or more active heat generating electronic components;

a substrate onto which said circuit is disposed;

a plurality of electrically and thermally conductive terminals; and a substantially metallic shield element, at least a portion of which is in contact with said substrate;

wherein said heat dissipation apparatus is configured to dissipate heat generated by said circuit via at least said terminals and said shield element.

2. The connector assembly of claim 1, wherein said circuit comprises a substantially bare integrated circuit die, said die being mated to said substrate using a chip-on-board process.

3. The connector assembly of claim 2, further comprising a thermal transfer medium disposed substantially between said die and at least a portion of said shield element.

4. The connector assembly of claim 3, further comprising an encapsulating material disposed substantially between and in physical contact with each of said die and said medium.

5. A modular jack adapted for use in a powered device and further adapted to receive a power-over-Ethernet (PoE) signal from another device over a twisted pair cable, said PoE signal comprising a power component and a data component, said modular jack further comprising:

a heat dissipation apparatus, said heat dissipation apparatus comprising:

a circuit comprising one or more active heat generating electronic components;

a substrate onto which said circuit is disposed;

a plurality of electrically and thermally conductive terminals; and a substantially metallic external shield element, at least a portion of which is in contact with said substrate;

wherein said heat dissipation apparatus is configured to dissipate heat generated by said circuit via at least said terminals and said shield element.

6. The modular jack of claim 5, wherein said circuit comprises a substantially bare integrated circuit die, said die being mated to said substrate using a chip-on-board process.

7. The modular jack of claim 6, further comprising a thermal transfer medium disposed substantially between said die and at least a portion of said shield element.

8. The modular jack of claim 7, further comprising an encapsulating material disposed substantially between and in physical contact with each of said die and said medium.

9. A connector assembly, comprising:

a connector housing comprising a recess adapted to receive at least a portion of a modular plug;

a first set of conductors disposed at least partly within said recess and adapted to interface electrically with said plug; and a removable insert structure comprising a first substrate comprising a plurality of electrically conductive pathways associated therewith, and at least one insert body comprising a plurality of electronic components disposed substantially therein;

wherein said removable insert structure further comprises a second set of conductors in signal communication with said powered device; and wherein said connector assembly comprises a power-over-Ethernet (PoE) front end circuit for a powered device (PD); and a heat dissipation apparatus, said head dissipation apparatus comprising:

a circuit, at least a portion of which comprises one or more heat generating electronic components for said PoE front end circuit;

a substrate onto which said circuit is disposed;

a plurality of electrically and thermally conductive terminals; and a substantially metallic shield element, at least a portion of which is in contact with said substrate;

wherein said heat dissipation apparatus is configured to dissipate heat generated by said circuit via at least said terminals and said shield element.

10. The connector assembly of claim 9, wherein said circuit comprises a substantially bare integrated circuit die, said die being mated to said substrate using a chip-on-board process.

11. The connector assembly of claim 10, further comprising a thermal transfer medium disposed substantially between said die and at least a portion of said shield element.

12. The connector assembly of claim 11, further comprising an encapsulating material disposed substantially between and in physical contact with each of said die and said medium.

13. A connector assembly adapted to receive power over cabling, comprising:

a connector housing comprising a recess adapted to receive at least a portion of a modular plug;

a first set of conductors disposed at least partly within said recess and adapted to interface electrically with said plug when said plug is inserted in said recess; and an insert element comprising a plurality of electrically conductive pathways associated therewith, and a plurality of electronic components disposed electrically within at least some of said pathways; and a heat dissipation apparatus, said heat dissipation apparatus comprising:

a circuit comprising one or more active heat generating electronic components;

a substrate onto which said circuit is disposed;

a plurality of electrically and thermally conductive terminals; and a substantially metallic shield element, at least a portion of which is in contact with said substrate;

wherein said heat dissipation apparatus is configured to dissipate heat generated by said circuit via at least said terminals and said shield element.

14. A modular jack adapted for use in a powered device and further adapted to receive a power-over-Ethernet (PoE) signal from another device over a cable, said PoE signal comprising a power component and a data component, said modular jack further comprising:

a heat dissipation apparatus comprising:

a circuit comprising one or more active heat generating electronic components;

a substrate onto which said circuit is disposed;

a plurality of electrically and thermally conductive terminals; and a substantially metallic external shield element, at least a portion of which is in contact with said substrate;

wherein said heat dissipation apparatus is configured to dissipate heat generated by said circuit via at least said terminals and said shield element.

15. A connector assembly, comprising:

a connector housing comprising a recess adapted to receive at least a portion of a modular plug;

a first set of conductors disposed at least partly within said recess and adapted to interface electrically with said plug; and and at least one insert body comprising a plurality of electronic components; and a heat dissipation apparatus, said head dissipation apparatus comprising:

a circuit comprising a power-over-Ethernet (PoE) front end circuit for a powered device (PD);

a substrate onto which said circuit is disposed;

a plurality of electrically and thermally conductive terminals; and a substantially metallic shield element, at least a portion of which is in contact with said substrate; and wherein said heat dissipation apparatus is configured to dissipate heat generated by said circuit via at least said terminals and said shield elements.

* * * * *

UNITED STATES PATENT AND TRADEMARK OFFICE

CERTIFICATE OF CORRECTION

PATENT NO. : 7,524,206 B2
APPLICATION NO. : 11/387226
DATED : April 28, 2009
INVENTOR(S) : Aurelio J. Gutierrez et al.

It is certified that error appears in the above-identified patent and that said Letters Patent is hereby corrected as shown below:

Column 30, Line 60 thru Column 32, Line 5

"15. A connector assembly, comprising:
a connector housing comprising a recess adapted to receive at least a portion of a modular plug; a first set of conductors disposed at least partly within said recess and adapted to interface electrically with said plug; and
and at least one insert body comprising a plurality of electronic components; and a heat dissipation apparatus, said head dissipation apparatus comprising: a circuit comprising a power-over-Ethernet (PoE) front end circuit for a powered device (PD); a substrate onto which said circuit is disposed; a plurality of electrically and thermally conductive terminals; and a substantially metallic shield element, at least a portion of which is in contact with said substrate; and wherein said heat dissipation apparatus is configured to dissipate heat generated by said circuit via at least said terminals and said shield elements."

Should Read

-- 15. A connector assembly, comprising:
a connector housing comprising a recess adapted to receive at least a portion of a modular plug; a first set of conductors disposed at least partly within said recess and adapted to interface electrically with said plug; and
and at least one insert body comprising a plurality of electronic components; and a heat dissipation apparatus, said head dissipation apparatus comprising: a circuit comprising a power-over-Ethernet (PoE) front end circuit for a powered device (PD); a substrate onto which said circuit is disposed; a plurality of electrically and thermally conductive terminals; and a substantially metallic shield element, at least a portion of which is in contact with said substrate; and wherein said heat dissipation apparatus is configured to dissipate heat generated by said circuit via at least said terminals and said shield element. --

Signed and Sealed this

Thirty-first Day of August, 2010

David J. Kappos

David J. Kappos
*Director of the United States Patent and Trademark Office*